US009958226B2

(12) United States Patent
Merritt et al.

(10) Patent No.: US 9,958,226 B2
(45) Date of Patent: May 1, 2018

(54) SYSTEMS AND METHODS FOR PROVIDING A MULTI-SHOT FIREARM

(71) Applicants: Michael Merritt, Moab, UT (US); Ludean Merritt, Moab, UT (US)

(72) Inventors: Michael Merritt, Moab, UT (US); Ludean Merritt, Moab, UT (US)

(73) Assignee: Launcher Technologies, Inc., Salt Lake City, UT (US)

( * ) Notice: Subject to any disclaimer, the term of this patent is extended or adjusted under 35 U.S.C. 154(b) by 110 days.

(21) Appl. No.: 15/018,754

(22) Filed: Feb. 8, 2016

(65) Prior Publication Data

US 2016/0245600 A1 Aug. 25, 2016

Related U.S. Application Data

(63) Continuation-in-part of application No. 14/294,112, filed on Jun. 2, 2014, now abandoned, which is a (Continued)

(51) Int. Cl.

| | |
|---|---|
| ***F41A 17/00*** | (2006.01) |
| ***F41A 19/13*** | (2006.01) |
| ***F41G 11/00*** | (2006.01) |
| ***F41A 3/66*** | (2006.01) |
| ***F41C 9/02*** | (2006.01) |
| ***F41C 27/00*** | (2006.01) |
| ***F41F 1/00*** | (2006.01) |
| ***F41G 1/35*** | (2006.01) |

(52) U.S. Cl.

CPC ..... *F41A 19/13* (2013.01); *F41A 3/66* (2013.01); *F41C 9/02* (2013.01); *F41C 27/00* (2013.01); *F41F 1/00* (2013.01); *F41G 1/35* (2013.01); *F41G 11/004* (2013.01)

(58) Field of Classification Search

CPC ..... F41A 5/16; F41A 9/27; F41A 9/28; F41C 3/14

USPC ..... 89/160, 161, 162, 163

See application file for complete search history.

(56) References Cited

U.S. PATENT DOCUMENTS

| | | | |
|---|---|---|---|
| 886,211 | A | 4/1908 | Hino et al. |
| 975,720 | A | 11/1910 | Risser |

(Continued)

FOREIGN PATENT DOCUMENTS

| | | | |
|---|---|---|---|
| WO | 2009/057175 | A1 | 5/2009 |
| WO | 2013/082532 | A1 | 6/2013 |

*Primary Examiner* — Gabriel Klein

(74) *Attorney, Agent, or Firm* — David B. Tingey; Bryant J. Keller; Kirton McConkie

(57) ABSTRACT

The present invention relates to firearms. In some cases, the firearms include a firing pin; a first ignition chamber that is configured to house a round of ammunition and to move proximally with respect to the firing pin so that when the round is in the first chamber and the firearm is fired, a portion of the round is struck against the firing pin. In some cases, the firearms also include a follower configured to be movable proximally and distally within the firearm and to be biased against a primer or proximal end of the round such that the follower is configured to selectively hold the round within the first chamber as the first chamber moves proximally, and such that proximal movement of the follower stops when the round strikes the firing pin, so that the follower acts as a bolt face for the round. Other implementations are also described.

19 Claims, 26 Drawing Sheets

Related U.S. Application Data continuation of application No. 13/691,333, filed on Nov. 30, 2012, now Pat. No. 8,739,447, which is a continuation-in-part of application No. 13/308,470, filed on Nov. 30, 2011, now Pat. No. 8,919,023.

(56) References Cited

U.S. PATENT DOCUMENTS

| | | | | |
|---|---|---|---|---|
| 1,073,312 | A | 9/1913 | Woods | |
| 1,436,534 | A | 11/1922 | Russell et al. | |
| 1,897,992 | A | 2/1933 | Ailes | |
| 2,042,934 | A | 6/1936 | Gill | |
| 2,512,998 | A | 6/1950 | Brock | |
| 2,601,613 | A | 6/1952 | Jahncke | |
| 2,775,178 | A | 12/1956 | Chambers et al. | |
| 3,020,662 | A | 2/1962 | Merkel | |
| 3,318,033 | A | 5/1967 | Barr | |
| 3,707,794 | A | 1/1973 | Rocha et al. | |
| 3,707,946 | A | 1/1973 | Muhlbach | |
| 3,788,191 | A | 1/1974 | Rose et al. | |
| 3,938,262 | A | 2/1976 | Dye et al. | |
| 4,028,994 | A | 6/1977 | Ferluga | |
| 4,061,075 | A | 12/1977 | Smith | |
| 4,083,138 | A | 4/1978 | Cash | |
| 4,086,682 | A | 5/1978 | Hancox | |
| 4,176,606 | A | 12/1979 | King et al. | |
| 4,268,987 | A | 5/1981 | Cash | |
| 4,348,716 | A | 9/1982 | Storm et al. | |
| 4,411,086 | A | 10/1983 | Christopherson | |
| 4,524,534 | A | 6/1985 | Kaye et al. | |
| 4,533,980 | A | 8/1985 | Hayes | |
| 4,644,930 | A | 2/1987 | Mainhardt | |
| 4,707,772 | A | 11/1987 | Jimenez et al. | |
| 4,748,759 | A | 6/1988 | Whiteing | |
| 4,905,396 | A | 3/1990 | Bechtel | |
| 5,092,071 | A | 3/1992 | Moore | |
| 5,107,612 | A | 4/1992 | Bechtel | |
| 5,123,329 | A | 6/1992 | Irwin | |
| 5,345,707 | A | 9/1994 | Randall | |
| 5,355,608 | A | 10/1994 | Teetzel | |
| 5,388,361 | A | 2/1995 | Farr | |
| 5,430,967 | A | 7/1995 | Woodman, III et al. | |
| 5,621,999 | A | 4/1997 | Moore | |
| 5,704,155 | A | 1/1998 | Primeau, IV | |
| 5,727,346 | A | 3/1998 | Lazzarini et al. | |
| 5,939,659 | A * | 8/1999 | Dobbins | F41A 5/16 89/161 |
| 6,270,231 | B1 | 8/2001 | Kerr | |
| 6,295,751 | B1 | 10/2001 | Piwonski | |
| 6,405,631 | B1 * | 6/2002 | Milek | F41A 5/20 42/10 |
| 6,565,226 | B1 | 5/2003 | Cummings | |
| 6,964,220 | B1 | 11/2005 | Lavin | |
| 7,305,790 | B2 | 12/2007 | Kay | |
| 7,448,307 | B1 * | 11/2008 | Dafinov | F41A 5/26 89/191.01 |
| 7,524,076 | B2 | 4/2009 | Kukuk | |
| 7,866,083 | B2 | 1/2011 | Teetzel | |
| 7,905,042 | B2 | 3/2011 | Carmel et al. | |
| 7,954,273 | B1 | 6/2011 | Swan | |
| 8,109,032 | B2 | 2/2012 | Faifer | |
| 8,127,485 | B2 | 3/2012 | Moore et al. | |
| 8,136,284 | B2 | 3/2012 | Moody et al. | |
| 8,191,302 | B1 | 6/2012 | Swan | |
| 8,327,574 | B2 | 12/2012 | Sandler et al. | |
| 8,529,083 | B1 | 9/2013 | Reed et al. | |
| 8,739,447 | B2 | 6/2014 | Merritt et al. | |
| 8,919,023 | B2 | 12/2014 | Merritt et al. | |
| 2002/0144446 | A1 | 10/2002 | Lindahl | |
| 2006/0027091 | A1 | 2/2006 | Ratti | |
| 2007/0151114 | A1 | 7/2007 | Papp et al. | |
| 2011/0252681 | A1 | 10/2011 | Houde-Walter et al. | |
| 2014/0338247 | A1 | 11/2014 | Merritt et al. | |

* cited by examiner

SYSTEMS AND METHODS FOR PROVIDING A MULTI-SHOT FIREARM

RELATED APPLICATIONS

This application is a continuation-in-part of U.S. patent application Ser. No. 14/294,112, entitled "SYSTEMS AND METHODS FOR PROVIDING A FIREARM WITH AN EXTENDABLE LIGHT SOURCE," filed Jun. 2, 2014, which is a continuation of U.S. patent application Ser. No. 13/691,333, entitled "SYSTEMS AND METHODS FOR PROVIDING A FIREARM WITH AN EXTENDABLE LIGHT SOURCE," filed Nov. 30, 2012 (now U.S. Pat. No. 8,739,447), which is a continuation-in-part of U.S. patent application Ser. No. 13/308,470, entitled "SYSTEMS AND METHODS FOR PROVIDING A CUSTOMIZABLE FIREARM," filed Nov. 30, 2011 (now U.S. Pat. No. 8,919,023), which are all hereby incorporated herein in their entirety.

BACKGROUND OF THE INVENTION

1. Field of the Invention

The present invention relates to firearms. In particular, some implementations of the present invention relate to systems and methods for making and using a firearm that can be customized to perform one or more functions, such as firing a bullet, firing a less-than-lethal projectile, and/or providing light. In some implementations, the firearm is configured to carry and fire multiple bullets, cartridges, rounds, and/or other projectiles before the firearm needs to be reloaded.

2. Background and Related Art

Guns currently exist that have characteristics to make them more practical or better suited for certain uses. For example, while some guns are specially configured for use in hunting, other guns are designed to be used in combat and tactical situations. Similarly, while some guns have longer barrels to increase their accuracy and bullet velocity, other guns have shorter barrels to make them easier to conceal. As a general rule, guns that are mounted against a user's shoulder, such as rifles and shotguns, are called long guns, while guns that can be held and operated with a single hand, such as pistols and revolvers, are called handguns.

Handguns can be useful for a variety of purposes. For instance, because some handguns are relatively small, they may be more practical than some long guns for use indoors and in situations where the object being shot at is relatively close to the shooter. Additionally, because some handguns can easily be hidden on a user's person, under a user's clothing, or in a user's bag, the user can carry such a gun without calling attention to that fact. As a result, the user can carry the handgun without causing unnecessary fear or anxiety to bystanders.

Despite their utility, handguns are not necessarily without their shortcomings. Indeed, as some handguns are intended to be readily fired, the safety mechanisms on such guns can be relatively easily to disengage or may even be non-existent. Accordingly, some such handguns may discharge unintentionally—potentially causing damage to property and even injury or death to the guns' users or to others. Additionally, some conventional guns are configured for a single use (e.g., firing a single type of bullet), and are not readily reconfigurable for multiple different uses (e.g., firing a bullet, firing a non-lethal projectile, firing a single shot, firing multiple shots before reloading, etc.).

Thus, while techniques currently exist that are used to provide handguns for a variety of purposes, challenges still exist. Accordingly, it would be an improvement in the art to augment or even replace current techniques with other techniques.

SUMMARY OF THE INVENTION

The present invention relates to firearms. In particular, some implementations of the present invention relate to systems and methods for making and using a firearm that can be customized to perform one or more functions, such as firing a bullet, firing a less-than-lethal projectile, and/or providing light. In some implementations, the firearm is configured to carry and fire multiple bullets, cartridges, rounds of ammunition, and/or other projectiles that can be fired before the firearm needs to be reloaded.

Implementation of the present invention takes place in association with a firearm. In some instances, the firearm is customizable to perform one or more functions, such as firing one or more bullets, firing a less-than-lethal projectile, and/or providing light. The firearm generally includes a main frame (or frame) component having an inner cavity, wherein a barrel is slidably received within the cavity so as to selectively slide proximally and distally (or back and forth) within the cavity. In some cases, a proximal end of the barrel comprises a projectile chamber (or ignition chamber). In such cases, the barrel fires the projectile by carrying the projectile proximally from a distal cocked position and striking the projectile against a stationary firing pin. In other cases, a firing pin is attached to a distal end of the barrel. In such cases, the barrel discharges the firearm by moving from a proximal cocked position so that the firing pin moves distally to strike a projectile housed in a launching platform at a distal end of the main frame. In some cases, the barrel rotates between a safe and a fire alignment.

In order to selectively lock the barrel in a cocked position (including a distal cocked position or a proximal cocked position), some implementations of the barrel comprise a catch on the barrel's outer surface. In such implementations, the firearm comprises a sear that runs transversely to a length of the barrel, wherein the sear is sized and shaped to selectively engage the catch when the barrel is in a cocked position and to disengage the catch to allow the barrel to slide to a discharged position.

In some cases, the firearm includes a firing pin; a first ignition chamber that is configured to house a round of ammunition and to move proximally with respect to the firing pin so that, when the round is in the first chamber and the firearm is fired, a portion of the round (e.g., a primer) is struck against the firing pin. In some cases, the firearm also includes a follower (or following pin) configured to be movable proximally and distally within the firearm and to be biased against a primer or proximal end of the round such that the follower is configured to selectively hold the round within the first chamber as the first chamber moves proximally, and such that proximal movement of the follower stops when (or, in some cases, shortly after) the round strikes the firing pin. Accordingly, in some such cases, the follower acts as a bolt face for the round to prevent the proximal end of the round from bulging, blowing out, and/or otherwise deforming.

While the methods and processes of the present invention can be particularly useful in the area of the described customizable firearm, those skilled in the art can appreciate that the described methods and processes can be used in a variety of different applications and in a variety of different areas of manufacture to yield a variety of different guns, including handguns (e.g., revolvers, semi-automatic guns, fully-automatic guns, derringers, pepperboxes, etc.), long guns (e.g., rifles, shotguns, etc.), and other mechanisms that can be used to launch one or more projectiles.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to firearms. In particular, some implementations of the present invention relate to systems and methods for making and using a firearm that can be customized to perform one or more functions, such as firing a bullet, firing a less-than-lethal projectile, and/or providing light. In some implementations, the firearm is configured to carry and fire multiple bullets, cartridges, rounds, and/or other projectiles before the firearm needs to be reloaded. The following disclosure of the present invention is grouped into three subheadings, namely "Providing a Firearm", "Providing an Extendable Light Source", and Providing a Multi-Shot Mechanism The utilization of the subheadings is for convenience of the reader only and is not to be construed as limiting in any sense.

Providing a Firearm

Figure 1:
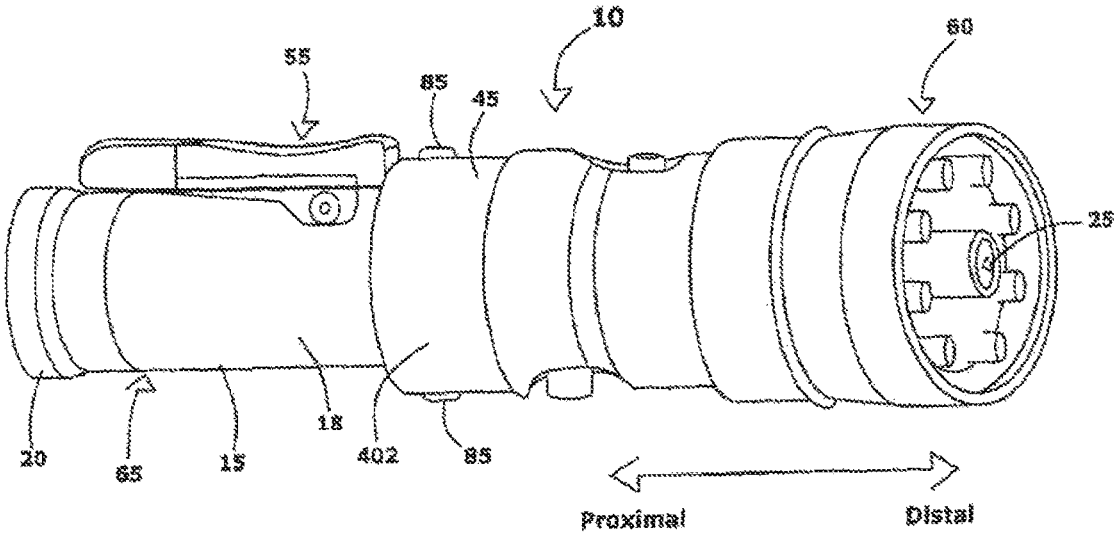
FIG. 1 illustrates a perspective view of a representative embodiment of a firearm.

The described systems and methods for providing a firearm that is capable of firing one or more projectiles. Indeed, some non-limiting examples of suitable firearms include handguns (e.g., revolvers; pistols, such as semi-automatic pistols, single shot pistols, machine pistols;

derringers; pepperboxes, etc.). In some non-limiting embodiments, however, the firearm comprises a firearm having a barrel that is able to move distally and/or or proximally within the firearm to cause a projectile to be discharged or be fired therefrom. Additionally, some embodiments of such a firearm comprise a safety mechanism in which the barrel itself is selectively rotatable between a fire alignment and a safe alignment. FIG. 1 shows a representative embodiment of such a firearm 10.

The described firearm 10 can be configured to shoot or discharge one or more types of projectiles. In this regard, some examples of suitable projectiles (or rounds) include one or more bullets, such as a rim-fire cartridge (e.g., a 0.22 round, a 0.22 magnum round, a 0.17 HMR round, a 0.17 HM2 round, etc.) and/or a center-fire cartridge (e.g., a 9 mm round, a 0.223 round, a shotgun cartridge, etc.); a blank round; a bean bag; a grappling hook and cord; a net; a cable; a rope; a golf-ball; a flash-bang; a tranquilizer; a flare; a grenade; a cartridge (e.g., a tear gas cartridge, a smoke bomb cartridge, an electroshock weapon cartridge, a shotgun cartridge, etc.); confetti; and/or any other object or objects that can be fired, shot, and/or otherwise discharged from the firearm.

Figure 2:
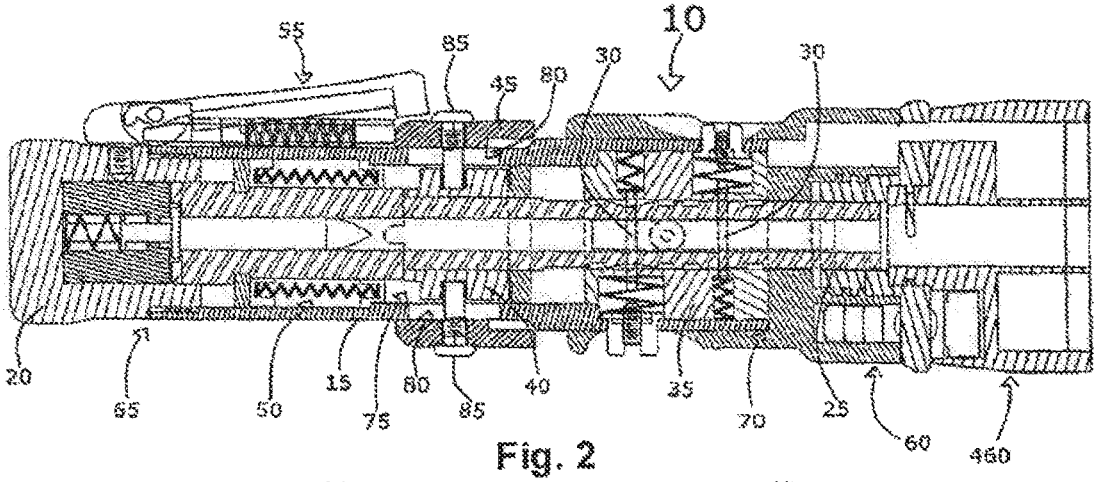
FIG. 2 illustrates a side, cross-sectional view of a representative embodiment of the firearm.

The described firearm 10 can comprise any suitable component that allows it to discharge a projectile (or other round). By way of illustration, FIG. 2 shows some embodiments in which the firearm 10 comprises a main frame 15, an end cap 20, a barrel 25 that is slidably received within the main frame 15, a sear 30, a trigger block 35, a cocking block 40, a cocking ring 45, a proximal biasing mechanism 50, a cocking assist mechanism 55, and a distal end attachment 60. To better describe the firearm, each of the aforementioned components is discussed below in more detail.

With respect to the main frame 15, the main frame can perform any suitable function, including acting as a sleeve that both houses various parts of the firearm 10 and that serves as a handle for holding the firearm. Furthermore, the main frame can have any suitable shape that allows it to function as intended. Indeed, in some non-limiting examples, the outer surface of the main frame is substantially cylindrical (e.g., so as to resemble some conventional flashlights), rectangular, octagonal, hexagonal, polygonal, irregular, etc. By way of illustration, FIG. 2 (and FIG. 1) shows some embodiments in which the outer surface 18 of the main frame 15 is cylindrically shaped.

While the main frame 15 can comprise any suitable component or characteristic that allows it to perform the described functions, FIG. 2 shows an embodiment in which the main frame 15 comprises a proximal end 65, a distal end 70, and an inner cavity 75 that extends between the two ends. Although the inner cavity 75 can perform any suitable function, FIG. 2 shows some embodiments in which it slidably receives the barrel 25, the cocking block 40, and the trigger block 35.

Figure 3A:
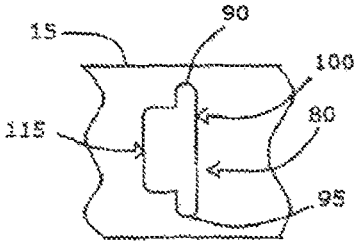
FIGS. 3A-3B each illustrate a plan view of a main frame defining an opening.
Figure 3B:
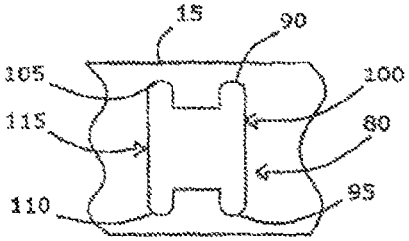

FIG. 2 also shows that, in some embodiments, the main frame 15 also comprises one or more main frame openings 80 that allow the cocking ring 45 to mechanically communicate with the cocking block 35 (e.g., via a pin 85). While the opening can have any suitable shape that allows the cocking ring to be used to move the barrel to a cocked position and/or between a fire and safe alignment (described hereinafter), FIG. 3A shows an embodiment in which the opening 80 optionally comprises a distal safety recess 90 and a distal fire recess 95 that are each disposed at opposite sides of a distal end 100 of the opening 80. As described hereinafter, the distal safety and fire recesses can allow the barrel 25 to rotate between a safe and a fire alignment when the firearm 10 is configured to fire a projectile through a proximal movement of the barrel. In another embodiment shown in FIG. 3B (e.g., an embodiment (not shown) in which the cocking block is configured in an H-shape, as mentioned below), the opening 80 optionally comprises a proximal safety recess 105 and a proximal fire recess 110 that are each disposed at opposite sides of a proximal end 115 of the opening. As described hereinafter, the proximal safety and fire recesses can allow the barrel to rotate between a safe and a fire alignment when the firearm is configured to fire a projectile through a distal movement of the barrel.

Figure 4A:
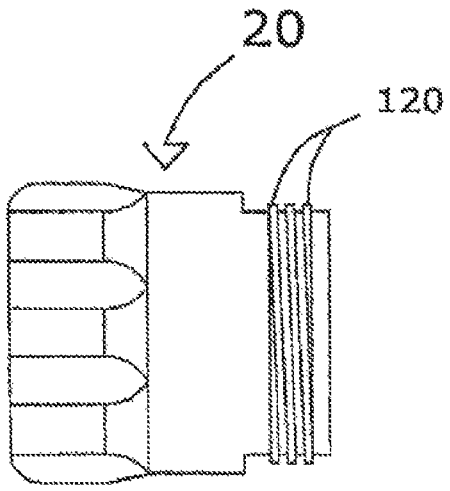
FIG. 4A illustrates a side elevation view of a representative embodiment of an end cap.

Regarding the end cap 20, the end cap can comprise any suitable component or characteristic that allows it to be removed so that a projectile (e.g., a bullet or bullet casing) can be loaded into and/or removed from the firearm 10. In some embodiments, the end cap comprises a connection mechanism that allows it to be selectively attached to and detached from the main frame 15. In this regard, some examples of suitable connection mechanisms include cylindrical threads that correspond to threads on the main frame, a bayonet lock, one or more mechanical fasteners, and/or any other suitable mechanism. By way of example, FIG. 4A shows an embodiment in which the end cap 20 comprises threads 120 that are configured to mate with threads (not shown in FIG. 4A) disposed in the main frame. While the threads 120 can have any suitable characteristic (e.g., lead, pitch, start, etc.) that allows them to be threaded with corresponding threads on the main frame 15, FIG. 4A shows an embodiment in which the threads 120 have a substantially squared profile.

Figure 4B:
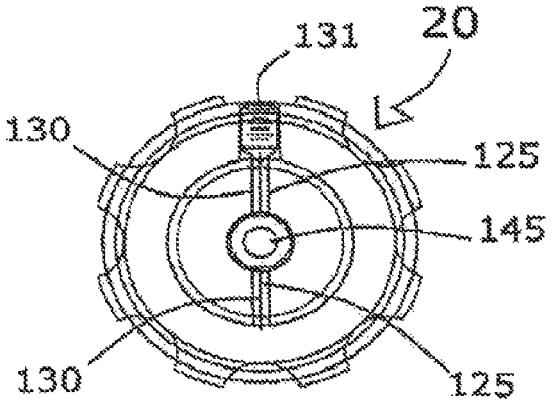
FIG. 4B illustrates a plan view of a representative embodiment of the end cap.

In some embodiments, the end cap 20 comprises one or more firing pins. While the end cap can comprise any suitable number of firing pins, including, 1, 2, 3, 4, or more, FIG. 4B shows that, in some embodiments in which the firearm 10 is configured to fire a rim-fire projectile (e.g., a 0.22 magnum round and/or any other suitable round), the end cap 20 comprises 2 firing pins 125, which can help provide a uniform ignition to the projectile.

The firing pins 125 can have any suitable characteristic that allows the firearm 10 to discharge or fire a projectile when the barrel 25 moves proximally to strike a projectile against the firing pins. Indeed, in some embodiments, the firing pins are stationary with respect to the end cap 20 (e.g., via a pin 131, such as an Allen screw, shown in FIG. 4B or in any other suitable manner). In other words, unlike some conventional firing pins that move to strike a projectile primer (e.g., a percussion cap, a rim fire, a primer cap, and/or any other suitable component), some embodiments of the described firearm have a firing pin that remains stationary so as to be struck by a primer that is carried to the stationary firing pin (e.g., via the sliding barrel 25, as discussed below).

Figure 5:
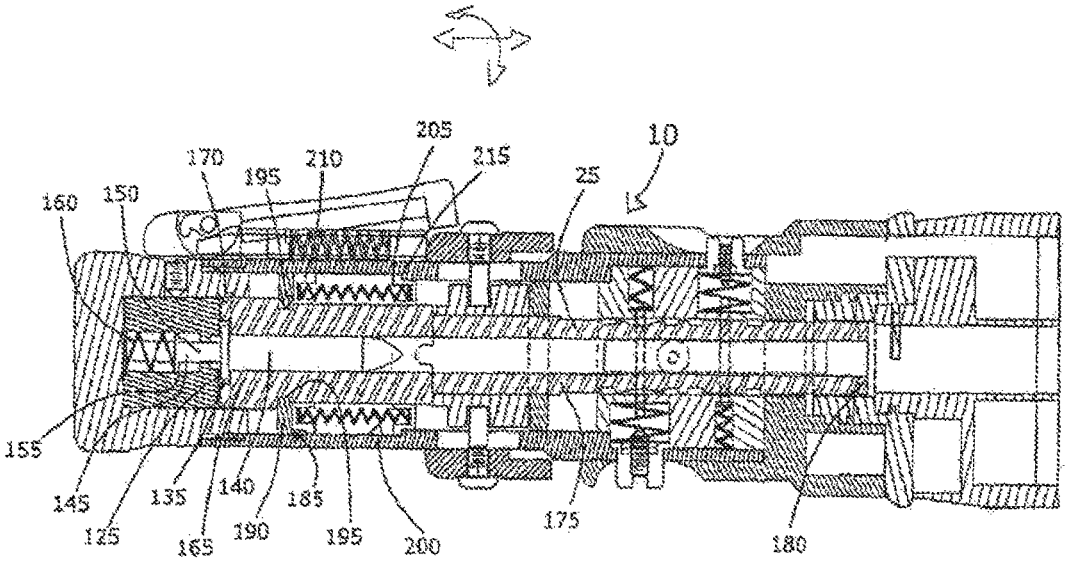
FIG. 5 illustrates a side, cross-sectional view of a representative embodiment of the firearm.

In another example of a suitable characteristic of the firing pins 125, each firing pin can comprise one or more pins, blades, posts, bumps, protuberances, and/or other members that allow the pin to function as intended. Indeed, in some embodiments in which the firearm 10 discharges a rim-fire projectile (e.g., a 0.22 magnum round), FIG. 4B shows the firing pins 125 comprise blades 130 that are sized and shaped to be struck by the rim 135 of a rim-fire bullet 140 (as shown in FIG. 5). In other embodiments in which the firearm fires a center-fire projectile (not shown), the firing pin comprises a pin and/or other suitable object that is configured to be struck by the projectile's primer.

The firing pin 125 can be disposed in any suitable location that allows it to fire a projectile when the projectile's primer strikes the pin. For instance, FIG. 4B shows an embodiment in which two firing pins 125 are disposed in-line with each other. In another embodiment (not shown), where the firing pin comprises a pin configured to be struck by the primer of a center-fire projectile, the pin is disposed in a position that allows the primer to strike the pin when the barrel moves proximally within the main frame 15.

In some embodiments, the end cap 20 further comprises a biased following pin. In such embodiments, the following pin can perform any suitable function, including acting to hold a projectile (e.g., bullet casing) in the barrel 25 by applying pressure to the proximal end of the projectile and/or acting as a bolt face to retain the projectile (e.g., the projectile's casing) in the barrel when the projectile is fired. Although the following pin can act as a bolt face in any suitable manner, in some embodiments as a projectile is forced proximally against the following pin, the following pin also moves proximally until it bottoms out, or it is otherwise prevented from moving further proximally. Accordingly, in some such embodiments, the following pin (or follower) is configured to abut and brace the proximal end of a projectile (or round) when the firearm 10 is discharged.

While the following pin can comprise any suitable component that allows it to perform the described functions, FIG. 5 shows an embodiment in which the following pin 145 (or follower) comprises a shaft 150, a following pin projection 155, and a following pin biasing mechanism 160 (e.g., one or more springs) that contacts the following pin projection to bias the following pin. In another embodiment (not illustrated), the shaft surrounds (or is proximate to) a stationary firing pin. In this embodiment, the firing pin extends distally past the following pin when following pin is forced proximally to its fullest extent. Accordingly, the firing pin and following pin in this embodiment allow the firearm 10 to discharge a center-fire round (e.g., a shotgun shell) through the proximal movement of the barrel 25.

The barrel 25 can comprise any suitable component or characteristic that allows it to slide proximally and/or distally in the main frame 15 in order to discharge or fire a projectile. In one example, FIG. 5 shows that the barrel 25 comprises a projectile chamber 165 at its proximal end 170 and an elongated cylindrical tube 175 that extends to a distal end 180 of the barrel 25. In this manner, the movement of a projectile disposed within the barrel can be tied to the movement of the barrel. In other words, when the barrel moves proximally within the main frame 15, a projectile (e.g., 0.22 round) disposed in the chamber will move likewise.

In some embodiments, the barrel 25 comprises a retention mechanism that allows the barrel to be biased by a proximal biasing mechanism, or a mechanism that biases the barrel in a proximal direction. In this regard, the retention mechanism can comprise any suitable component that allows the proximal biasing mechanism to bias the barrel. By way of non-limiting example, FIG. 5 shows an embodiment in which the retention mechanism 185 comprises a retainer (e.g., a C-washer) 190 that mates with a retainer groove 195 in the barrel 25.

The proximal biasing mechanism can comprise any component that allows it to bias the barrel 25 proximally in the main frame 15. Indeed, while the proximal biasing mechanism 200 can comprise one or more springs, FIG. 5 shows an embodiment in which the biasing mechanism 200 comprises multiple springs 205 that extend between a proximal spring carrier 210 and a distal spring carrier 215. While the biasing mechanism can comprise any suitable number of springs, including, 1, 2, 3, 4, 5, 6, 7, 8, 9, 10, or more, in some embodiments, the biasing mechanism comprises 10 coiled springs that are equally spaced apart (e.g., each within a corresponding depression of the proximal 210 and distal 215 spring carriers) to allow the proximal biasing mechanism to apply a substantially uniform force around a circumference of the barrel.

While the springs 205 in the proximal biasing mechanism 200 can have any suitable characteristic that allows them to bias the barrel 25 to move towards a discharged position, in some embodiments, the springs are configured to apply little to no tension on the barrel when the barrel is in the discharged position (or a position in which the barrel is moved to its proximal-most position, as shown in FIG. 5). Thus, when the barrel is moved distally toward a distal cocked position (as described below); the proximal biasing mechanism biases the barrel towards the firing pins 125.

Figure 6A:
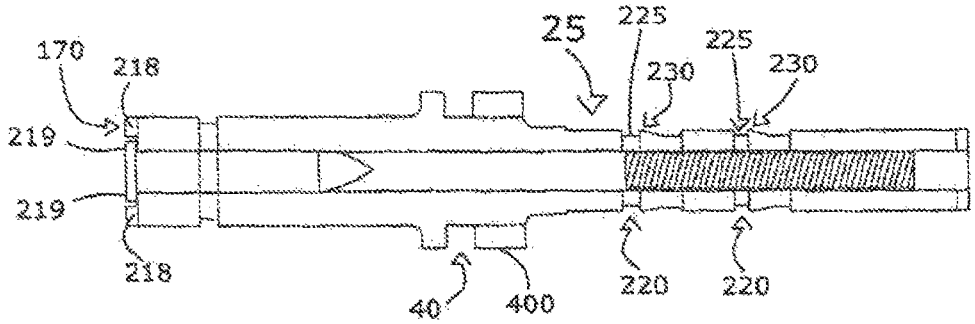
FIG. 6A illustrates a side, cross-sectional view of a representative embodiment of a barrel.
Figure 6B:
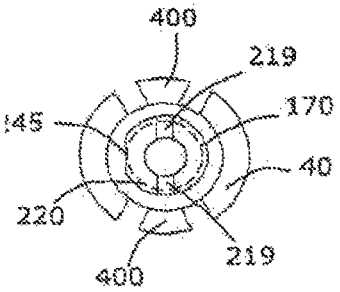
FIG. 6B shows a schematic view of a proximal end of a representative embodiment of the barrel.

Returning to the barrel 25, FIGS. 6A and 6B show that, in some embodiments in which the firearm 10 fires rim-fire projectiles, the proximal end 170 of the barrel comprises a firing pin groove 218 that corresponds to each firing pin 125. In such embodiments, the firing pins are only able to strike a projectile's primer 219 when the barrel is rotated so that the groove is in alignment with the firing pins. In other words, when the barrel is rotated so that the groove is out of battery with the firing pins, the barrel will strike firing pins and prevent the projectile's primer from striking the firing pins. Accordingly, the firing pin groove can act as safety mechanism to prevent the firearm from being accidentally discharged.

Figure 6C:
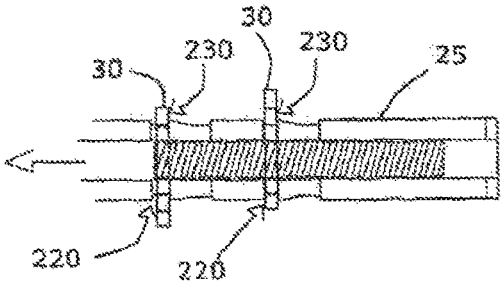
FIG. 6C illustrates a side, cross-sectional view of a portion of representative embodiment in which the barrel is caught by a pair of sears.
Figure 7A:
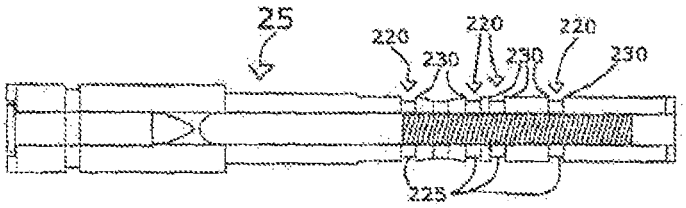
FIG. 7A illustrates a side, cross-sectional view of a representative embodiment of the barrel.
Figure 7C:
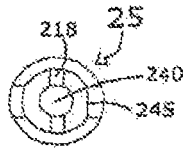
FIGS. 7C-7D each illustrate an end view of the barrel in accordance with a different representative embodiment.
Figure 7B:
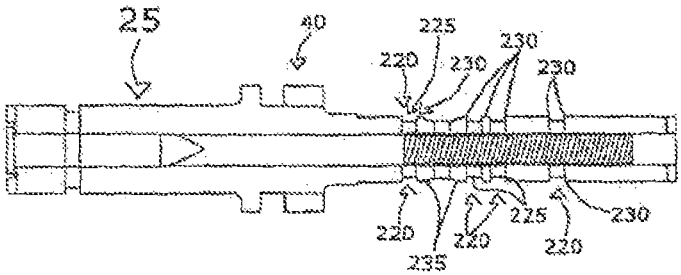
FIG. 7B illustrates a side, cross-sectional view of a representative embodiment of the barrel that includes a representative embodiment of a cocking block.

In some embodiments, the barrel 25 comprises one or more catches on its external surface. In such embodiments, the barrel can comprise 1, 2, 3, 4, or more catches. By way of illustration, FIGS. 6A and 6C show some embodiments in which the barrel 25 comprises 2 catches 220, while FIGS. 7A and 7B show some embodiments in which the barrel 25 comprises 4 catches 220.

Although the catches 220 can serve any suitable function, in some embodiments, one or more catches on the barrel 25 are sized and shaped to be captured by a sear 30 (discussed below) when the barrel is moved to a distal cocked position (shown in FIG. 8A) or a proximal cocked position (shown in FIG. 8B). In this regard, each catch can have any suitable component or characteristic that allows it to perform the described function. For instance, each catch can comprise a groove, a rib, a stop, and/or a protrusion. By way of illustration, FIGS. 7A and 7B show some embodiments in which the catches 220 each comprises a sear groove 225 disposed near a raised surface 230. Additionally, FIGS. 7A and 7B show that the barrel 25 optionally comprises one or more sloped surfaces 235 to help the sear 30 (shown in FIGS. 8A and 8B) engage the catch when the barrel is moved to a cocked position (i.e., a proximal or a distal cocked position).

Figure 7D:
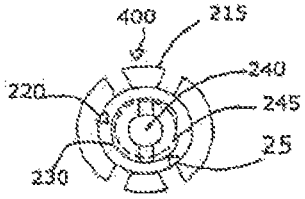

In some embodiments, the barrel 25 is configured to be able to slide past a corresponding sear 30 when the barrel has been rotated about its longitudinal axis 240 to a fire alignment and to be captured by the sear when the barrel is rotated from the fire alignment to a safe alignment. While the barrel can be have any suitable characteristic that allows it to function as described, FIGS. 7C and 7D show an embodiment in which the barrel 25 comprises a flat portion 245 of the raised surface 230 of the catch 220. The manner in which this flat portion functions with the sears is further described below in the discussion regarding the sears 30.

Figure 8A:
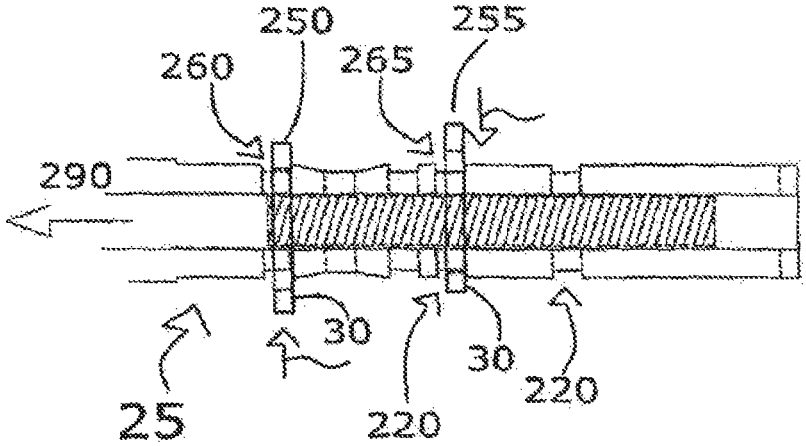
FIG. 8A illustrates a side, cross-sectional view of a representative embodiment of a portion of the barrel captured at a distal cocked position.

As mentioned, some embodiments of the firearm 10 comprise at least one sear 30. Indeed, while the firearm can comprise any suitable number of sears, including 1, 2, 3, 4, or more, FIGS. 8A and 8B show some embodiments in which the firearm comprises 2 sears 30. The sears can each function in any suitable manner that allows them to selectively engage and disengage a corresponding catch 220. By way of illustration, FIG. 8A shows that when the barrel 25 is moved distally to the distal cocked position, a first 250 sear and second sear 255 respectively slip into a first sear groove 260 and a second sear groove 265. FIG. 8B shows that when the barrel 25 is moved proximally to a proximal cocked position (a further discussion of why the barrel can be placed in a proximal cocked position is provided below in a discussion of a launching platform), the first 250 and second 255 sears respectively slide into a third sear groove 270 and a fourth sear groove 275. Thus, when the sears are forced out of the grooves (e.g., by moving the sears in the direction of arrows 280 and 285), the barrel 25 in FIG. 8A is able to move proximally (in the direction of arrow 290) from the distal cocked position towards the firing pins 125, while the barrel 25 in FIG. 8B is able to move distally (in the direction of arrow 290) from the proximal cocked position to strike a projectile primer disposed near a distal end of the main frame (as described below).

Figure 9A:
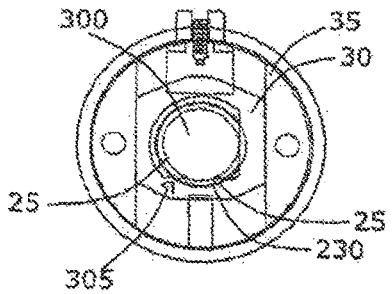
FIG. 9A illustrates a face, schematic view of a representative embodiment of a sear, wherein the sear is set in a first layer of a representative embodiment of a trigger block.

The sears 30 can comprise any suitable characteristic or component that allows them to function as described. For instance, FIG. 9A shows an embodiment in which a sear 30 defines a hole 300 that is sized and shaped to allow the barrel 25 to pass therethrough. Additionally, FIG. 9A shows that the sear 30 comprises a catch surface 305. While the catch surface can perform any suitable function, in some instances, when the barrel is moved so that a sear groove 225 aligns with the sear 30, the catch surface slides in a first direction into the groove and contacts the raised surface 230 to prevent the barrel from moving proximally or distally within the main frame 15. In contrast, when the sear is forced in a second direction that is opposite to the first direction, the catch surface is moved out of the groove so that the barrel is able to slide past the sear (e.g., from the cocked position to a discharged position).

Figure 9B:
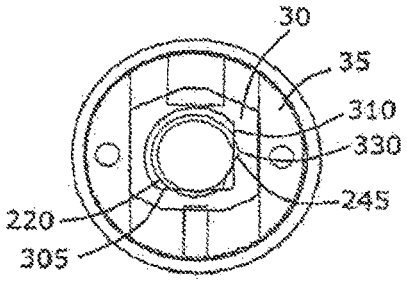
FIG. 9B illustrates a face, schematic view of a representative embodiment of a sear comprising a safety catch, wherein the barrel is not disposed in a fire alignment position, and wherein the sear is disposed in a second layer of a representative embodiment of the trigger block.
Figure 9C:
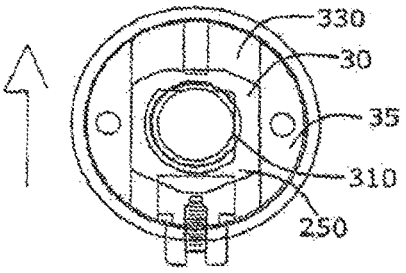
FIGS. 9C-9D each illustrate a face, schematic view of a representative embodiment of the sear.

In some embodiments, one or more sears 30 optionally comprise a safety catch. While the safety catch can perform any suitable function, in some embodiments, the safety catch is sized and shaped so that once the sear is engaged with a corresponding barrel catch 220, the safety catch will only disengage the catch when the barrel is rotated to its fire alignment position. While the safety catch can have any suitable characteristic that allows it to function as intended, in some embodiments, the safety catch corresponds with the flat portion 245 of the barrel 25. Thus, FIG. 9B shows that when a sear 30 is engaged with a barrel catch, and when the barrel 25 is rotated so that its flat portion 245 is not aligned with the safety catch 310, the raised surface 330 is unable to slide past the safety catch, even if the catch surface 305 were disengaged from the raised surface. In contrast, FIG. 9C shows that the sear 30 can be released from the barrel catch when the barrel 25 is rotated (as described below) so that its flat portion 245 aligns with the safety catch 310 (e.g., so that the firing pin groove 218 is aligned with the firing pin 125).

Figure 8B:
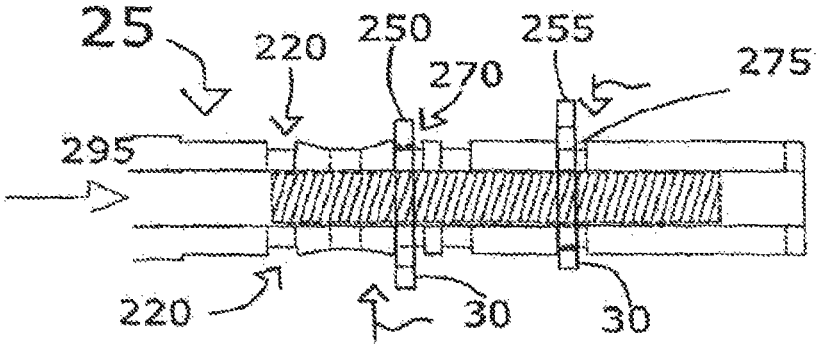
FIG. 8B illustrates a side, cross-sectional view of a representative embodiment of a portion of the barrel captured at a proximal cocked position.
Figure 9D:
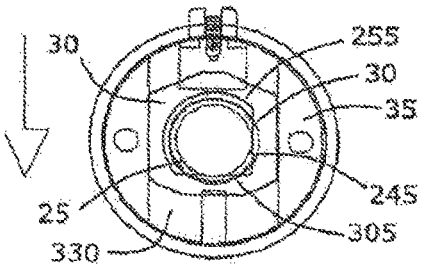
Figure 10:
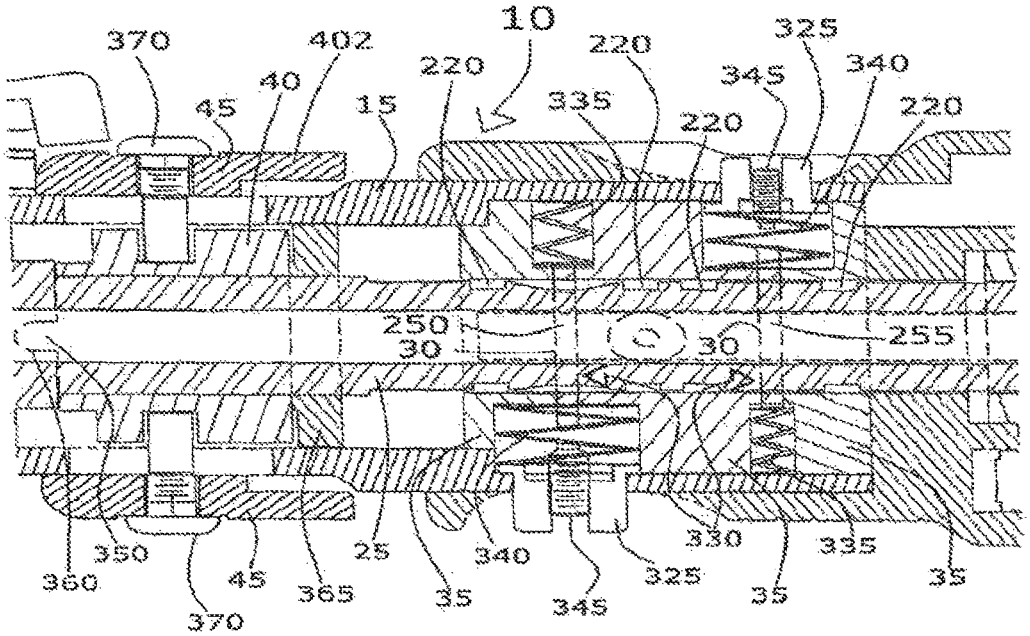
FIG. 10 illustrates a side cross-sectional view of a portion of a representative embodiment of the firearm.

The sears 30 can be positioned in any suitable place within the firearm 10 that allows them to capture a corresponding barrel catch 220 when the barrel 25 is moved to a proximal cocked position (shown in FIG. 8A) and/or a distal cocked position (shown in FIG. 8B). In one example, FIGS. 9C and 9D show that the sears 30 (e.g., sears 250 and 255) run substantially transverse to the length of the barrel 25. Additionally, while the sears can be disposed in any suitable orientation with respect to each other, FIGS. 9C through 10 show some embodiments in which the first 250 and second 255 sears are disengaged by moving the sears in substantially opposite release directions (as illustrated by arrows 315 and 320, respectively). Accordingly, as shown in FIG. 10, in some embodiments, the sears 250 and 255 are operated by buttons 325 (or triggers) that are disposed on opposite sides of the main frame 15. Thus, where the firearm 10 comprises two sears (e.g., sears 250 and 255), the barrel 25 can be released from its cocked position as both sears and simultaneously disengaged from a corresponding barrel catch 220.

While the sears 30 can be disposed in the firearm 10 in any suitable manner, FIG. 10 (as well as FIGS. 9C and 9D) show some embodiments in which each of the sears 30 is slidably disposed within a slot 330 of the trigger block 35. Additionally, while the sears can be operated in any suitable manner, FIG. 10 shows an embodiment in which each sear 30 has a first sear biasing device (e.g., one or more springs) that biases the corresponding sear towards a corresponding button 325. Additionally, FIG. 10 shows an embodiment in which each sear 30 has a second sear biasing device (e.g., spring) that is weaker than the first sear biasing device 335, and that serves to bias a corresponding button 225 away from the sear 30. Thus, when the firearm is cocked, the barrel 25 is in fire alignment (where applicable), and as a user pushes the button sufficiently hard, the button forces the corresponding sear (e.g., pin 345) to move and to disengage from any barrel catch 220.

In some cases, in order to adjust how far the buttons 325 must be forced before the sears 30 can be disengaged (and the firearm 10 can be discharged), FIG. 10 shows that each button 325 is optionally adjustable. Although the buttons can be adjusted in any suitable manner, FIG. 10 shows some embodiments in which each button 325 comprises an adjustable pin (e.g., an Allen screw or other screw) that can be tightened or loosened in order to adjust the stroke of the button that is needed to disengage the corresponding sear.

With respect to the cocking block 40, the cocking block 40 can be attached to the barrel 25 in any suitable manner. By way of example, the cocking block can be integrally formed with, welded to, attached with mechanical fasteners, or otherwise attached to the barrel in a manner that enslaves the movement of the cocking block to the movement of the barrel. Indeed, FIG. 10 shows an embodiment in which the cocking block 40 includes one or more tabs 350 at its proximal end 355 that mate with corresponding slots 360 in the barrel 25. Additionally, FIG. 10 shows that, in some implementations, a distal fastener (e.g., a threaded washer 365) is used to secure the cocking block 40 to the barrel 25.

Figure 11:
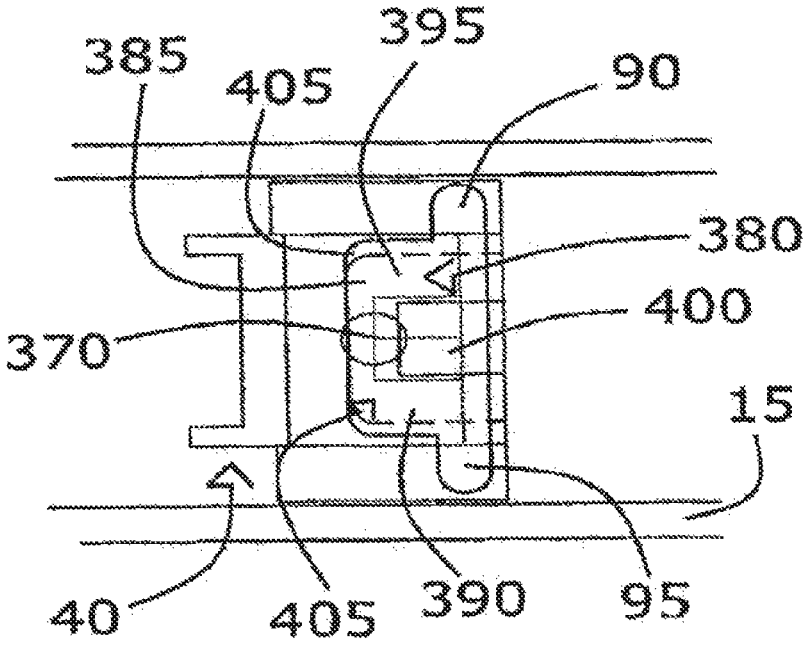
FIG. 11 illustrates a top, schematic view of a representative embodiment of an opening in the main frame and a representative embodiment of a cocking block channel having a portion of a representative cocking ring member disposed therein.

The cocking block 40 can have any suitable characteristic that allows the barrel 25 to be moved proximally and/or distally within the main frame 15 and/or to be rotated between a fire alignment and a safe alignment through distal and/or proximal movement and/or rotation of the cocking ring 45. In this regard, some embodiments of the cocking block include at least one channel that receives a member (e.g., pin 370) extending from the cocking ring. While this channel can have any suitable shape (including a U-shape, an H-shape, a V-shape, etc.), FIG. 11 shows an embodiment in which the channel 375 includes a U-shaped portion 380. More specifically, FIG. 11 shows an embodiment in which the channel 375 comprises a channel that runs transverse to the length of the barrel 25 (the transverse channel 385) and two channels that run with the length of the barrel (the fire channel 390 and the safety channel 395), wherein the two channels are separated by a tang 400.

The cocking ring 45 can comprise any suitable component that allows its distal, proximal, and/or rotational movement about the main frame 15 to cause the barrel 25 to move distally, proximally, and/or to rotate. In some embodiments, however, the cocking ring comprises an element that is movably attached to the firearm (e.g., a ring 402 (see FIG. 10) extending around a circumference of the main frame), wherein the element comprises one or more cocking ring members 370 (e.g., pins, projections, bolts, screws, etc.) that are attached to the member, that extend through the opening 80 in the main frame 15, and that are movably received in the channel 375 of the cocking block 40.

The cocking ring 45 can interact with the cocking block 40 in any suitable manner that allows the cocking ring to move the barrel 25 to a cocked position (e.g., a distal and/or proximal cocked position) and/or between a fire alignment (e.g., an alignment in which the firing pin grooves 218 at the proximal end 170 of the barrel are in battery with the firing pins 125) and a safe alignment (e.g., an alignment in which the grooves at the proximal end of the barrel are not in battery with the firing pins). In one example in which the firearm 10 is cocked by moving the barrel to the distal cocked position (as shown in FIG. 8A), the cocking process involves ensuring that the cocking ring member 370 is disposed within the transverse channel 385 (as shown in FIG. 11). Thus, when the cocking ring member is disposed within the fire channel 390 or the safety channel 395, the cocking ring is moved proximally until the cocking ring member is disposed within the transverse channel.

Figure 12B:
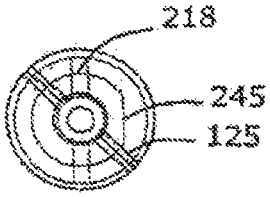
FIGS. 12B, 12D, and 12F each illustrate a view showing the relationship between a firing pin and a firing pin groove for the embodiments that are respectively set forth in FIGS. 12A, 12C, and 12E.
Figure 12D:
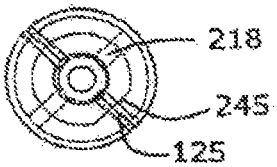
Figure 12A:
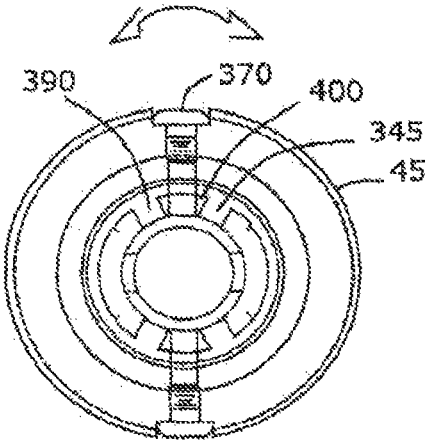
FIGS. 12A, 12C, and 12E each illustrate a cross-sectional schematic view of a representative embodiment of the firearm taken through the cocking block.

Once the in cocking ring member 370 is disposed within the transverse channel 385, the cocking ring 45 can be rotated until the cocking ring member is disposed proximal to the tang 400 (as shown in FIG. 12A). At that point, the ring is pushed distally, so that the cocking ring member pushes the tang (and hence the barrel 25) to move distally until the sears 30 engage corresponding catches 220 (e.g., first groove 260 and second groove 265) and the barrel is locked in the distal cocked position.

Figure 12C:
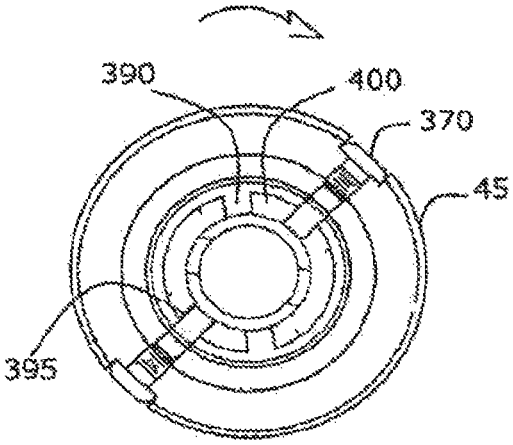

Once the barrel 25 is cocked, the cocking ring 45 can further be rotated so the cocking ring member 370 moves in the transverse channel 385 to the proximal end 405 of either the fire channel 390 or the safe channel 395. When the cocking ring member 370 is disposed at the proximal end of the of the safe channel 395 (as shown in FIG. 12C), FIG. 12D shows that the firing pin grooves 218 and the firing pins 125 are out of battery with each other. Thus, in embodiments in which the sears 30 lack a safety catch 310, when a user disengages all sears, the barrel 25 can slide proximally as the cocking ring member 370 slides through the safe channel. That said, the barrel would protect the projectile's primer from being struck against the firing pins.

Figure 12F:
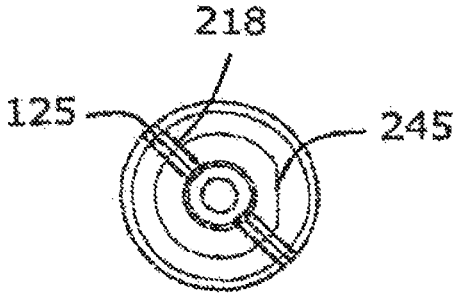
Figure 12E:
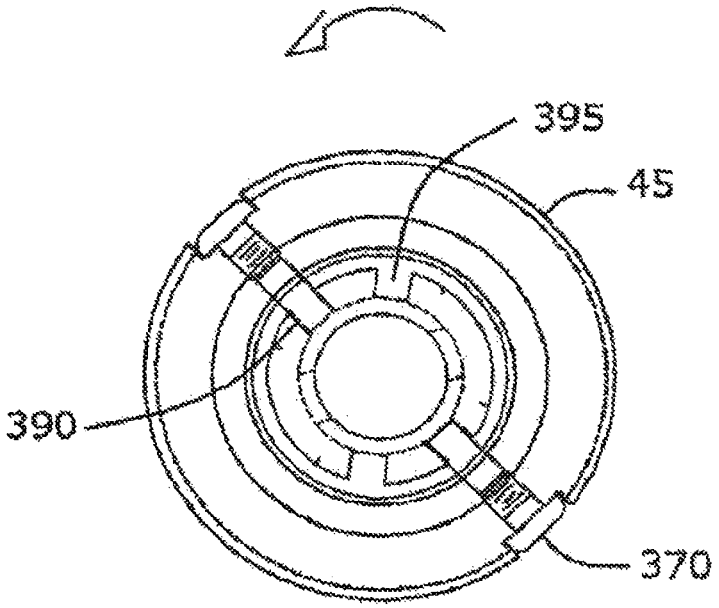

In contrast, where the cocking ring member 370 is moved to the proximal end of the fire channel 390 (as shown in FIG. 12E) and the cocking ring member 370 is pushed into the distal fire recess 95 (where applicable), FIG. 12F shows that the firing pin grooves 218 and the firing pins 125 are in battery with each other. Thus, if a user were to release the sears 30, the barrel 25 would be able to slide proximally as the fire channel slides past the cocking ring member and a primer of a projectile in the chamber 165 would be discharged as it strikes the firing pins.

In another example in which the firearm 10 is cocked by moving the barrel 25 to the proximal cocked position (as shown in FIG. 8B and as further discussed below), the cocking process involves moving the cocking ring 45 proximally to ensure the cocking ring member 370 is disposed in the transverse channel 385. Once the cocking ring member is in the transverse channel, the cocking ring can be moved proximally, causing the barrel to move proximally, until one or more sears 30 capture corresponding barrel catches 220 (e.g., third groove 270 and fourth groove 275).

Once the barrel 25 is captured in the proximal cocked position, the cocking ring 45 can be rotated to place the cocking ring member 370 at the proximal end of the safe channel 395 or the fire channel 390. When the cocking ring member is disposed at the proximal end of the safe channel and the cocking ring member is rotated into the proximal fire recess 110 (e.g., so that the firing pin grooves 218 and firing pins 125 are aligned), the sears 30 can be released (e.g., by simultaneously pressing buttons 325) so that a distal biasing mechanism (described below) can cause the barrel to slide distally within the firearm 10.

In some embodiments, the firearm 10 optionally comprises a cocking assist mechanism 55. In such embodiments, the cocking assist mechanism can comprise any suitable component or characteristic that allows it help a user move the cocking ring 45 distally on the main frame 15. In one example (not shown), the cocking assist mechanism comprises a lever that is pivotally connected to the main frame so as dispose a cam head near the cocking ring. In this example, when the lever is rotated from its original position, the cam head moves so the cocking ring can be pulled proximally. Then, when the lever is rotated back to its original position, the cam head forces the cocking ring to be moved (and to remain) distally on the main frame.

Figure 13A:
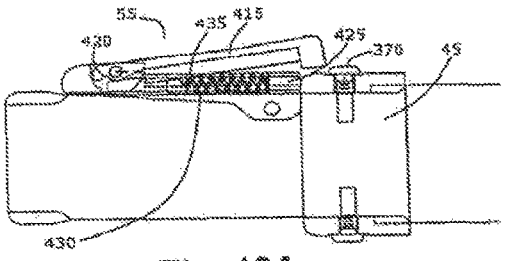
FIGS. 13A-13C each illustrate a side, partial cutaway view of an embodiment of the firearm comprising a representative embodiment of a cocking assist mechanism in a different position.
Figure 13C:
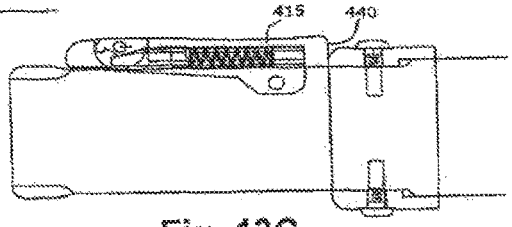
Figure 13B:
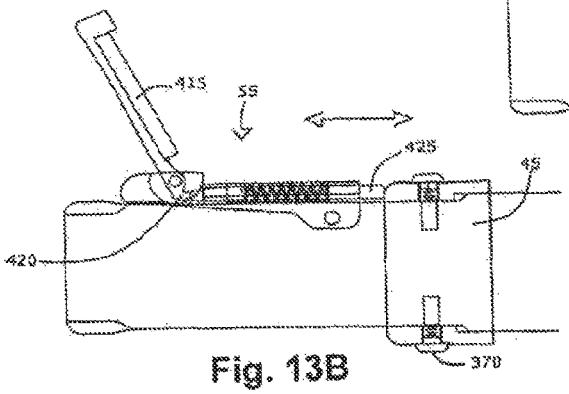

In another example of a suitable cocking assist mechanism 55, FIG. 13A shows an embodiment in which the cocking assist mechanism 55 comprises lever saddle 410, a lever 415 having a cam action pin 420, a slip pin 425, and a cam-pin biasing member 430 (e.g., one or more springs) that applies force to the slip pin (e.g., a pin 435, flange, protrusion, or other connector on the slip pin) to bias the slip pin proximally. In this example, when the lever 415 is lifted (as shown in FIG. 13B), the cam action pin 420 forces the slip pin 425 to move distally. In this manner, the slip pin can force the cocking ring 45 to move distally on the main frame 15 (e.g., to the distal cocked position). Once the cocking ring is moved to a distal position, the lever can be lowered (as shown in FIG. 13C) so that a lever face 440 of the lever 415 prevents the cocking ring from moving proximally until the lever is lifted again.

In some embodiments, the firearm 10 optionally includes a distal end attachment 60 that is disposed at the distal end 70 of the main frame 15. Some examples of suitable distal attachments include a cover, a flashlight, a launching platform, a light source attachment mechanism, a grip, a barrel protector, a sight, a scope, a spear attachment, and/or any other suitable component that can be attached (directly or indirectly) to the distal end of the main frame.

Although in some embodiments, the distal attachment 60 is integrally formed with or attached to the main frame 15, in other embodiments, the distal attachment is configured to be selectively coupled to and decoupled from the main frame. In such embodiments, the distal attachment and/or main frame can comprise any suitable attachment mechanism that is capable of attaching a component to the main frame's distal end 70. Some examples of suitable attachment mechanisms include one or more screw threads, bayonet attachments, adaptors having threads on one side and a bayonet attachment on the other, mechanical fasteners, clips, adapters, the extension of the buttons 325 through holes in the distal attachment, and/or any other suitable mechanism.

Figure 14:
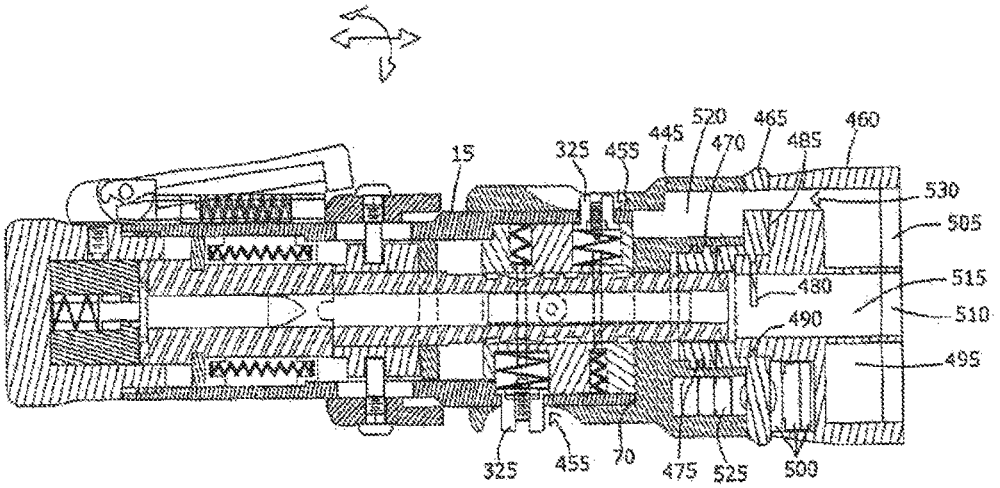
FIG. 14 illustrates a side, cross-sectional view of a representative embodiment of the firearm comprising a representative embodiment of a flashlight.
Figure 15B:
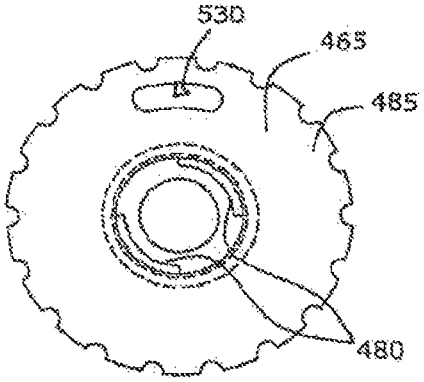
FIGS. 15A-15B illustrate different views of a representative embodiment of an adaptor.
Figure 15D:
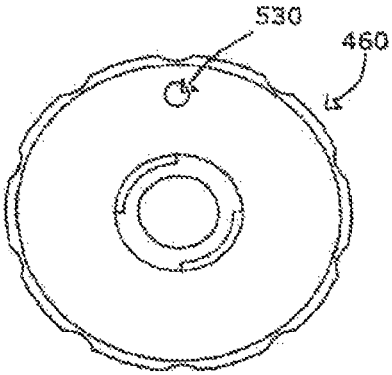
FIGS. 15C-15D illustrate different views of a representative embodiment of the flashlight.
Figure 15A:
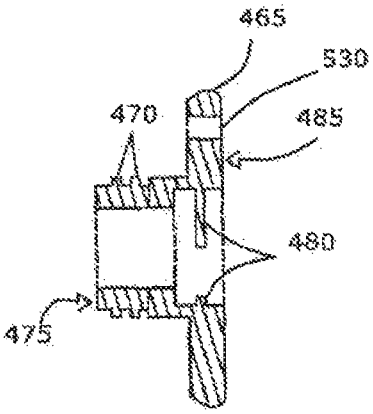
Figure 15C:
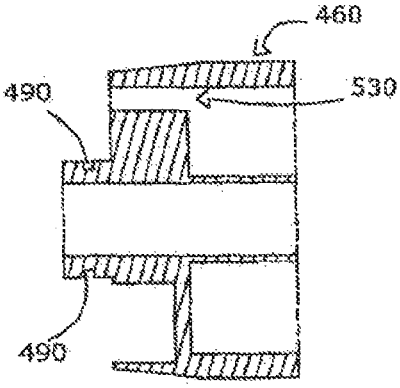

In one example, FIG. 14 shows an embodiment in which a cover 445 is attached to the distal end 70 of the main frame 15 through the use of one or more mechanical fasteners 450 (e.g., screws) and/or the buttons 325 extending through holes 455 holes in the cover. In another example, FIG. 14 (as well as FIGS. 15A through 15D) show some embodiments in which a flashlight 460 attaches to the main frame 15 via an adapter 465 having threads 470 on its proximal side 475 and a bayonet attachment 480 on its distal side 485. In this example, FIG. 14 shows the flashlight 460 comprises a mating bayonet attachment 490 that allows the flashlight to be attached or detached from the adaptor 465 by turning the flashlight a quarter of a turn.

Where a flashlight 460 attaches at the distal end 70 of the firearm 10, the flashlight can have any suitable component or characteristic that allows it to provide light while allowing the firearm to shoot a projectile through the flashlight. Although one or more components (e.g., batteries, switches, wires, electrical connectors, etc.) of the flashlight are disposed in some embodiments of the firearm, in other embodiments, the flashlight is completely self-contained—meaning that the flashlight can provide light without being attached to the firearm. While such a self-contained flashlight can comprise virtually any component that allows it to function as described herein, FIG. 14 (and FIG. 15C) shows an embodiment in which the flashlight 460 comprises one or more light sources 495 (e.g., high-intensity LEDs, incandescent bulbs, etc.), batteries 500, lenses 505 with a hole 510 that allows a projectile to pass therethrough, and holes 515 that pass through the flashlight.

In addition to the described features and components, the firearm 10 can be modified in any suitable manner that allows it to function as described herein. Indeed, in one example, the firearm comprises a laser aiming system. While the laser and its various components can be disposed in any suitable component of the firearm, including the main frame 15 and/or distal attachment 60 (e.g., the flashlight 460), FIG. 14 shows an embodiment in which the laser aimer 520 and its batteries 525 are disposed near the main frame's distal end 70 and in which the flashlight 460 defines an opening 530 that allows the laser beam (not shown) to shine through the flashlight. While the laser aimer can be turned on and off in any suitable manner, in some embodiments, the laser aimer is operated by a switch associated with one or more of the buttons 325 that control the sears 30.

Figure 16:
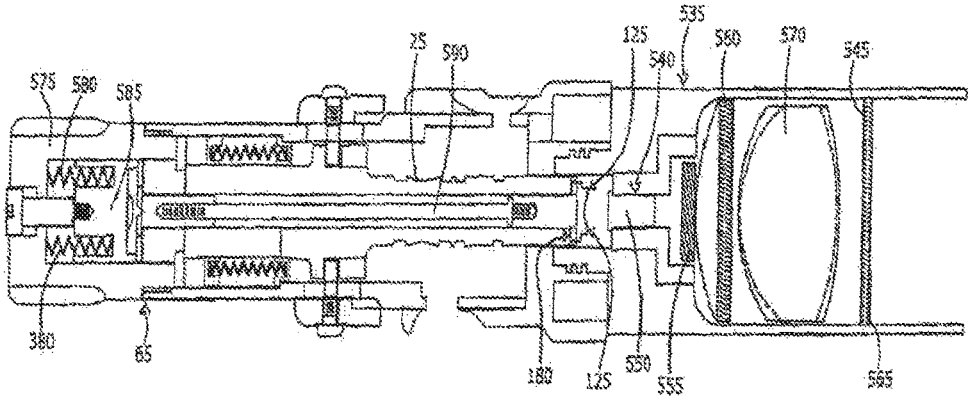
FIG. 16 illustrates a side, cross-sectional view of a representative embodiment of the firearm comprising a representative embodiment of a launching platform.

In another example, the firearm 10 is modified as a launching platform that is attached at the distal end 70 of the main frame 15. In this example, the launching platform can comprise any suitable component that allows the firearm to shoot or discharge a projectile that is disposed near the distal end of the main frame (as opposed to firing a projectile that is disposed at a proximal end 170 of the barrel 25). By way of illustration, FIG. 16 shows an embodiment in which the launching platform 535 comprises a chamber 540 and a projectile cavity 545. In this regard, while the chamber can be used to hold any type of projectile (e.g., a lethal round, such as a center-fire round or a rim-fire round), in some embodiments, FIG. 16 shows the chamber 540 holds a blank round 550 to convert the firearm to a less-lethal or a less-than-lethal device that can launch one or more relatively large objects (such as bean bags, canisters, nets, balls, ropes, or other projectile objects).

The platform 535 can have any suitable component or characteristic that allows a projectile to be launched from it. By way of illustration, FIG. 16 shows an embodiment in which the launching platform 535 comprises a wad 555 disposed adjacent to the blank 550 and a seal (e.g., a thick seal 560 and a thin seal 565 on each side of a projectile 570 (e.g., a large bag).

Where the firearm 10 comprises a launching platform 535, the firearm can be configured to discharge a projectile from the platform in any suitable manner that involves releasing the barrel 25 from the proximal cocked position (as described above) and allowing the barrel to slide distally within the main frame 15. In one example, the firearm is modified so it has a distal biasing mechanism that is capable of forcing the barrel distally (or forward) when the barrel is released from the proximal cocked position. For instance, FIG. 16 shows an embodiment in which a modified end cap 575 comprising a distal biasing mechanism 580 (e.g., one or more springs) and a hammer 585 is attached to the proximal end 65 of the main frame 15.

Figure 17:
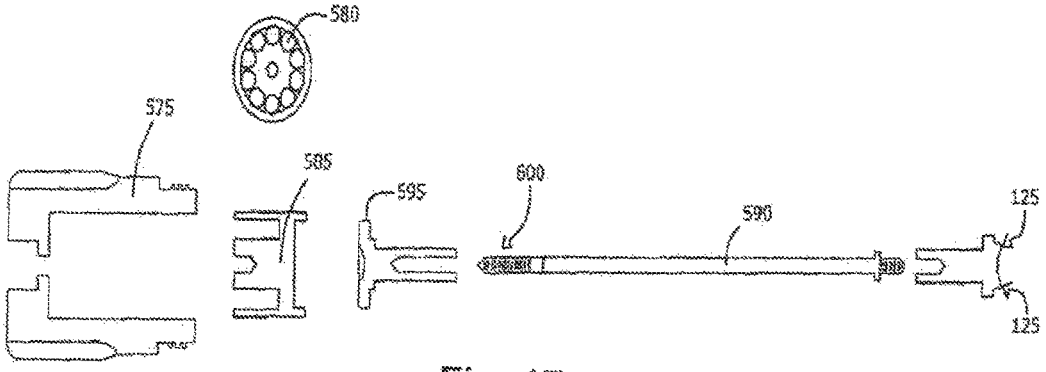
FIG. 17 illustrates a side, exploded view of a representative embodiment of some components that are used to modify the firearm and make it able to shoot projectiles from the launching platform.

In another example of how the firearm 10 can be modified to fire projectiles from the launching platform 535, the barrel 25 is configured to comprise one or more firing pins 125 at its distal end 180. While the firing pins can be disposed at the distal end of the barrel in any suitable manner, FIGS. 16 and 17 show that, in some embodiments, a rod 590 is inserted into the barrel 25, wherein the rod comprises one or more firing pins 125 at its distal end 590. While the rod can be secured in the barrel in any suitable manner, FIGS. 16 and 17 show some embodiments in which a proximal flange 595 is attached (e.g., threaded, frictionally engaged, or otherwise coupled to) to a proximal end 600 of the rod. Thus, when the barrel is released from the proximal cocked position, the firing pins move distally to strike the primer of the projectile 550 disposed in the launching platform and thereby shoot the projectile.

In addition to the foregoing characteristics, in some embodiments, the firearm 10 is configured to attach to virtually any suitable object that is capable of supporting the firearm. In one example, the firearm is configured to attach to another weapon, which can include, but is not limited to, any suitable gun (e.g., a tactical weapon, such as an AR-15-style gun, an AR-10 style gun, etc.; a shotgun; a rifle; a black-powder gun; and any other suitable long gun, handgun, and/or other weapon). In this example, the firearm can serve any suitable purpose, such as providing a laser or light pointing/aiming system, providing a high-intensity tactical flashlight (as discussed below), providing a secondary weapon (e.g., in addition to or in place of a bayonet), providing a launching system for launching projectiles (e.g., grenades, teargas canisters, flares, beanbag rounds, animal baton rounds, etc.).

Where the firearm 10 is configured to attach to another object (e.g., another gun), the firearm can attach to the other object in any suitable manner, including, without limitation, through the use of any suitable mounting mechanism that is able to attach the firearm to a portion of the object (e.g., a barrel of a gun, a receiver of a gun, or any other suitable portion of a weapon), a sight or accessory mount (e.g., a WEAVER® rail, a Picatinny rail, a riser rail, a scope base, etc.), and/or any other suitable location.

Figure 22:
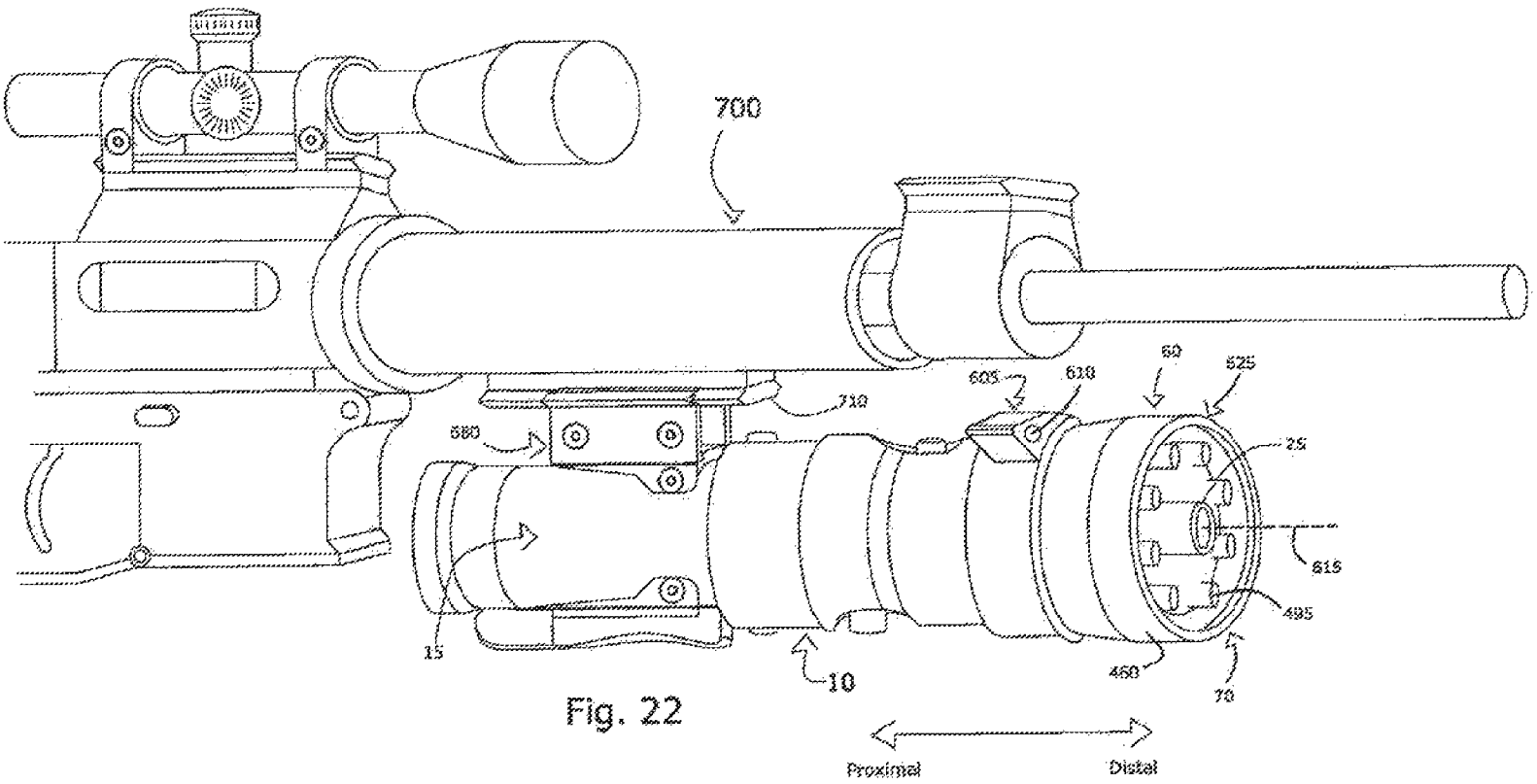
FIG. 22 illustrates a perspective view of a representative embodiment of the firearm, wherein the firearm is attached as an accessory to a representative embodiment of a conventional weapon.
Figure 24:
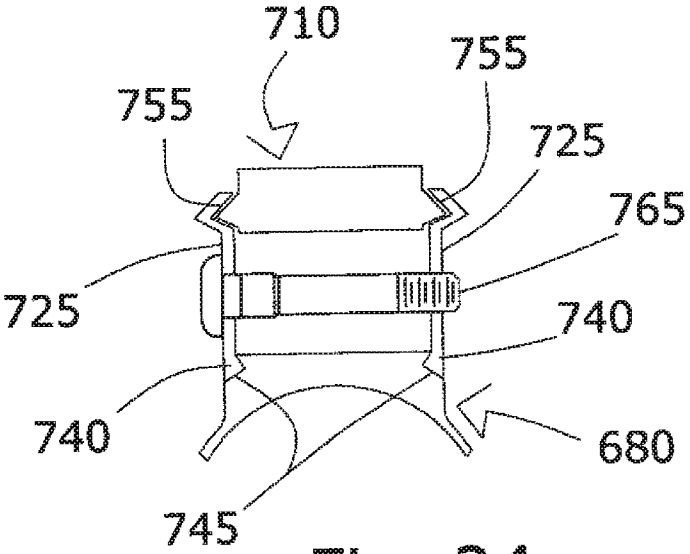
FIGS. 23 and 24 illustrate different views of a representative embodiment of a firearm mounting mechanism.
Figure 23:
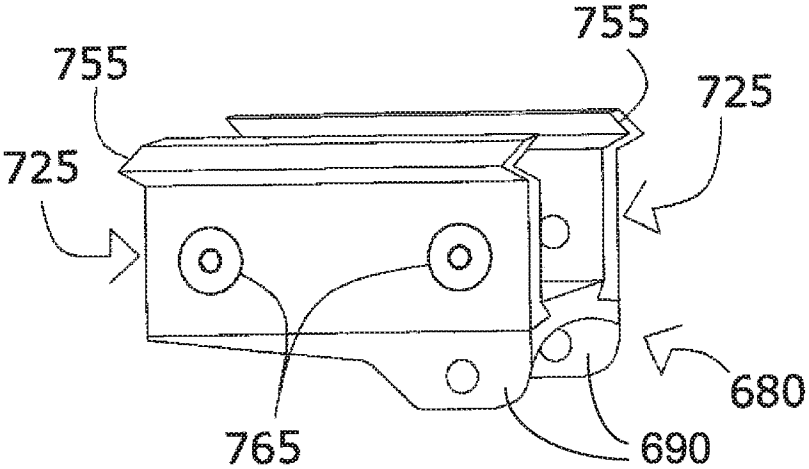

While the firearm mounting mechanism can comprise any suitable component or characteristic that allows it to attach the firearm 10 to another object, FIG. 22 illustrates a representative embodiment in which the mounting mechanism comprises a clamp 680 that is capable of attaching the firearm 10 to an accessory rail 710 (e.g., WEAVER® rail, a Picatinny rail, a riser rail, etc.) on a tactical weapon (e.g., an AR-16 style gun 700). Although the clamp 680 can comprise any suitable component that allows it to perform its intended purpose, FIGS. 22 through 24 show that, in some embodiments, the clamp 680 comprises a surface 690 for attaching to the firearm 10 (e.g., for attaching to the firearm's main frame 15 via one or more welds, fasteners, clamping mechanisms, adhesives, and/or other suitable manners). Additionally, FIGS. 23 and 24 show some embodiments in which the clamp 680 comprises two blades 725 that are disposed substantially opposite to each other. As the two blades 725 each comprise a groove 755 that corresponds to a ridge on an accessory rail 710, FIGS. 22 through 24 show that the clamp 680 is able to slidably receive the accessory rail 710, and that one or more fasteners 765 (e.g., screws) can be tightened and/or loosened to respectively attach and/or detach the firearm 10 from the rail 710.

Providing an Extendable Light Source

Figure 18:
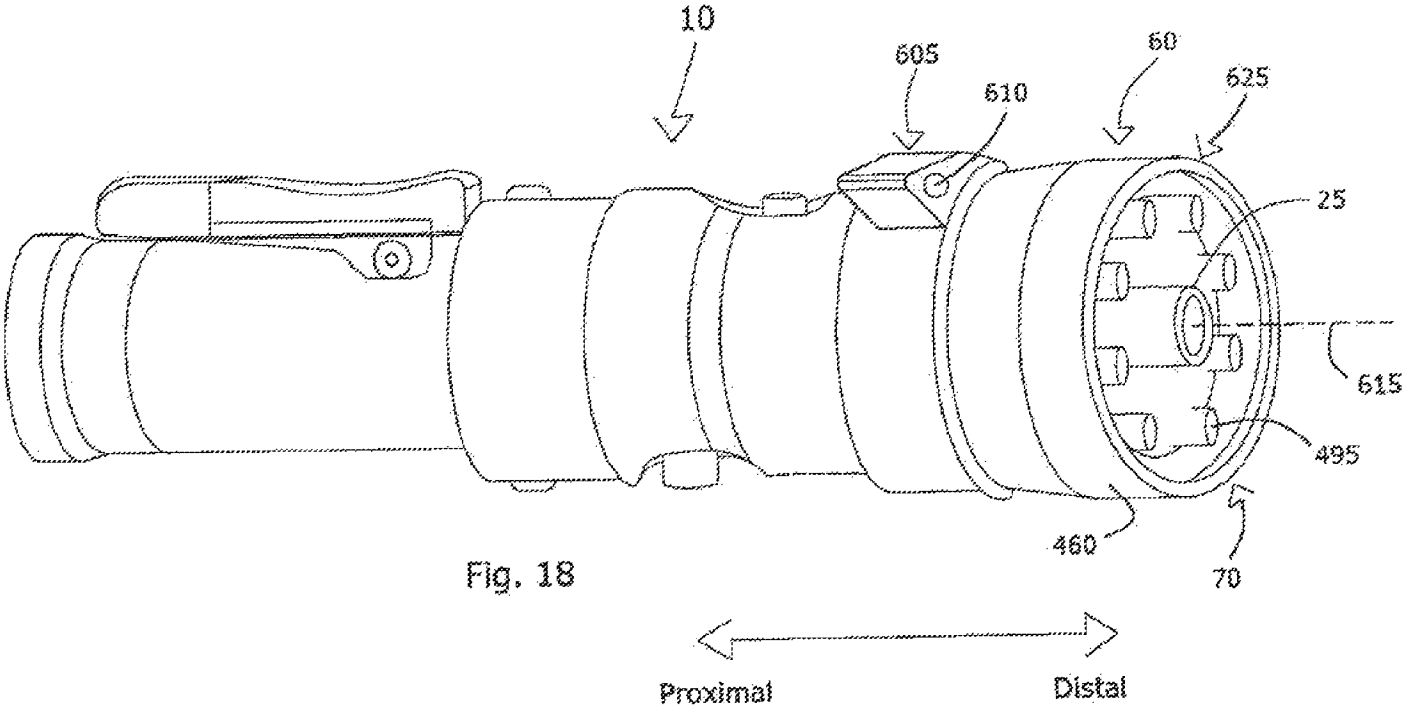
FIG. 18 illustrates a perspective side view of the firearm, wherein an extendable light source is attached to the firearm, in accordance with a representative embodiment.

The extendable light source can comprise any suitable light emitting object that can be attached to a firearm (e.g., the customizable firearm 10 or any other suitable firearm) in a manner that allows the light source to be selectively moved between a first and a second position, wherein the first position is closer than the second position to a longitudinal axis of the firearm's barrel (e.g., barrel 25). Some non-limiting examples of suitable light emitting objects include one or more lasers (e.g., a laser aimer, a red and green laser, etc.), dazzlers lights (e.g., LEDs, incandescent bulbs, halogen lamps, high intensity discharge lights, strobe lights, electron stimulated lights, electroluminescent lamps, etc.), and/or other suitable light emitting devices. In some embodiments, however, the light source comprises a laser and/or a light. By way of non-limiting illustration, FIG. 18 shows a representative embodiment in which the light source 605 comprises a laser aimer 610.

Figure 19C:
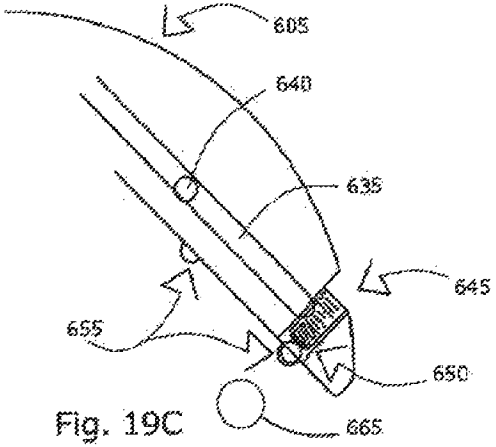
FIG. 19C illustrates a front schematic view of a representative embodiment of a portion of the light attachment mechanism illustrated in FIG. 19B.
Figure 19B:
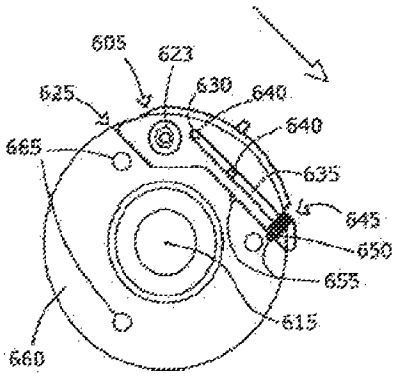
FIG. 19B illustrates a front schematic view, in accordance with some embodiments, of a light source attachment mechanism, wherein the light source is in the first position.
Figure 19A:
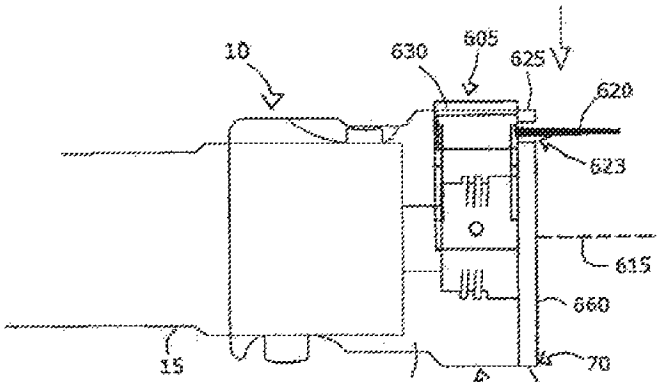
FIG. 19A illustrates a side schematic view of a portion of the firearm having a the extendable light source in a first position, in accordance with a representative embodiment.
Figure 20A:
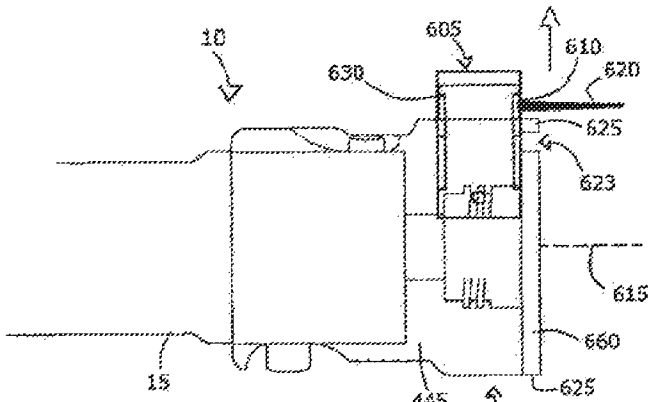
FIG. 20A illustrates a side schematic view of a portion of the firearm having the extendable light source in a second position, in accordance with a representative embodiment.

As previously stated, the light source 605 can be selectively moved between at least a first position and a second position. In this regard, the first position can be virtually any position that is closer to a longitudinal axis 615 of the firearm's barrel (e.g., barrel 25) than is the second position. In some non-limiting embodiments, when the light source is in the first position, the light emitting portion (e.g., the light bulb, the laser light emitting portion, etc.) of the light source is at least partially disposed within (e.g., so as to shine within) a lateral perimeter of the distal end 70 of the firearm (e.g., firearm 10). In this regard, the term lateral perimeter of the distal end of the firearm may refer to an outer perimeter of a distal portion of the firearm (including, without limitation, the main frame 15, a pistol slide, a handle, a platform, etc.) and/or a distal end attachment 60 (e.g., a cover 445, a flashlight 460, a launching platform 535, a grip, a barrel protector, etc.), wherein the outer perimeter extends laterally around at least a portion of the barrel or the barrel's longitudinal axis. By way of non-limiting illustration, FIG. 19A shows an embodiment in which the light source 605 is able to shine a light 620 (e.g., a laser beam) within a lateral perimeter 625 of the firearm's distal end 70 (e.g., via opening 623).

The second position can be any suitable position that is farther (laterally) from the barrel's longitudinal axis 615 than is the first position. Indeed, in some non-limiting embodiments, when the light source 605 is in the second position, the light emitting portion (e.g., the light bulb, the laser light emitting portion, etc.) of the light source is at least partially disposed outside of a lateral perimeter 625 of the distal end 70 of the firearm (e.g., firearm 10). By way of non-limiting illustration, FIG. 19B shows an embodiment in which the light source 605 is able to shine a light 620 (e.g., a laser beam) outside of the lateral perimeter 625 of the firearm's distal end 70. Accordingly, when a distal end attachment 60 that lacks an opening 623 for the light source is attached to a distal end of the firearm, the light source can be moved to the second position to allow the light source to shine past the distal end attachment.

The light source 605 can move between the first and second positions (and/or any suitable position in between) in any suitable manner, including, without limitation, by sliding, pivoting, raising, lowering, twisting, caming, flipping, and/or otherwise moving closer to or farther from the longitudinal axis 615 of the firearm's barrel (e.g., barrel 25). Indeed, in some embodiments, the light source pivots between the first position and the second position. In one example (not illustrated) of such an embodiment, the light source is attached at a first end of a one or more levers, while a second end of the lever(s) is pivotally attached to the firearm (e.g., firearm 10) so that the light source can pivot towards the longitudinal axis of the barrel to place the light source in the first position, and away from the barrels' longitudinal axis to place the light source in the second position.

Figure 20B:
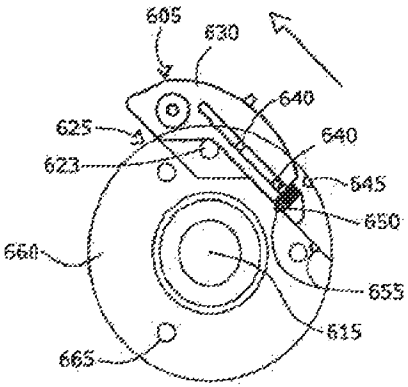
FIG. 20B illustrates a front schematic view of representative embodiment of a light source attachment mechanism, wherein the light source is in the second position.

In some other embodiments, the light source 605 is able to slide between the first and second position. In this regard, the light source can slide between the two positions in any suitable manner, including, without limitation, through the use of a guide and follower mechanism, a bearing slide, a slide rail, a groove, a piston, and/or another suitable mechanism that allows the light source to move closer to and farther from the longitudinal axis 615 of the firearm's barrel (e.g., barrel 25). Where the light source uses a guide and follower mechanism, that mechanism can comprise any suitable components that allows one portion (e.g., one or more grooves, slots, rails, threaded pins, pins, etc.) of the mechanism to act as a guide for another portion (e.g., one or more pins, grooves, slots, rails, etc.) that follows the guide portion. By way of non-limiting illustration, FIGS. 19B and 20B show some embodiments in which an extension member 630 that houses the light source 605 comprises a slot 635 that is guided by a plurality of pins 640 that are fixed in position with respect to the firearm 10.

In some embodiments, the light source 605 is optionally selectively maintainable in (and releasable from) one or more positions (e.g., the first position, the second position, and/or one or more positions between the first and second). In this regard, the light source can be selectively maintained in and released from a position through the use of any suitable retention mechanism. Some non-limiting examples of such retention mechanisms include one or more detent mechanisms, clamps, ratchets (e.g., a ratchet that raises and selectively locks into one or more positions and then lowers when the light source is raised past the second position), locking pistons (e.g., a spring loaded piston mechanism in which the light source is released to move from the first position to the second position when the piston is pushed past the first position (closer to the barrel's longitudinal axis 615) and in which the piston is locked back into the first position when the piston is pushed back (a second time) past the first position), screws, frictional engagements, mechanical engagements, pawls and corresponding catches, detent spring and ball mechanisms, spring-loaded ball mechanisms, screws, screw mechanisms, and/or other mechanisms that are capable of selectively maintaining (and releasing) the light source in (and from) a desired position. By way of non-limiting example, FIGS. 19B, 19C, and 20B each illustrate a representative embodiment in which the light source 605 comprises a detent mechanism 645 that is able to selectively maintain the light source in a desired position (e.g., the first position, the second position, and any position in between) by biasing a member (e.g., a ball and spring 650) into a recess 655 at each desired position.

The light source 605 can be attached to the firearm (e.g., firearm 10 or any other suitable firearm, such as a handgun, a long gun, etc.) at any suitable location and in any suitable manner that allows the light source to function as intended. In some embodiments, the light source attaches to the firearm's frame (e.g., main frame 15), to (or as) a distal end attachment 60, at the firearm's stock (not shown), attached at a slide of the firearm (e.g., a pistol slide, not shown), and/or any other suitable location. In one non-limiting example, FIGS. 19A and 19B each show an embodiment in which the light source 605 is disposed in the extension member 630, which is attached to a distal end attachment 60 (e.g., cover 445) via a plate 660 that is attached to the firearm. While the plate 660 in this example can attach to the distal end attachment via one or more fasteners (e.g., pins, screws, rivets, etc.) that extend through holes 665 in the plate 660 and attach to the distal end attachment 60, the plate can attach to the distal end attachment in any other suitable manner, including, without limitation through a threaded attachment mechanism, a clamping mechanism, and/or in any other suitable manner.

In another non-limiting embodiment, the light source 605 is disposed in a light source attachment mechanism (e.g., between two plates, not shown) that can be selectively added to and removed the firearm 10.

Figure 21:
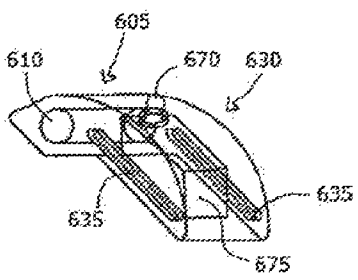
FIG. 21 illustrates a perspective schematic view of a representative embodiment of an extension member that houses the light source.

The various components of the light source 605 (e.g., one or more batteries, pieces of circuitry, wires, circuit boards, switches, light producing components, and/or other parts) can be disposed in any suitable location that allows the light source to function as intended. In one example, the various components of the light source are disposed at the light source extension member 630. By way of illustration, FIG. 21 shows an embodiment in which the extension member 630 comprises a switch 670 and a cavity 675 for containing various portions of the light source (e.g., batteries, circuitry, etc.). In other embodiments (which are not shown), the various components of the light source are disposed in the firearm or in both the firearm and the extension member. Accordingly, in some embodiments, the light source can be activated from the firearm (e.g., by depressing button 325).

As shown above, the described extendable light 605 source can have several features. In one non-limiting example, the because the light source can be used in the first or second position, a firearm comprising the light source can be customized in several ways while still allowing the light source to function as intended. For instance, when the firearm (e.g., firearm 10) and/or a distal end attachment 60 (e.g., the flashlight 460) comprise an opening 530 for the light source to shine through, the light source can be used in the first position. In contrast, when the firearm is customized to include a distal end attachment (e.g., the launcher platform 535) that lacks such an opening, the light source can be moved to the second position, where it is able to shine past a lateral perimeter of the distal end attachments. Accordingly, in some embodiments, the light source is able to be used on a firearm while allowing the firearm to be customized with one or more distal end attachments that would block the light source in the first position. In another non-limiting example, some embodiments of the light source are easily concealable within the firearm. Thus, in some embodiments, the light source can be stored out of the way, and in a manner that does not readily identify the firearm as a potential weapon.

The extendable light source 605 can be made in any suitable manner that forms the structures described. By way of example, the various components of the light source can be formed through a process involving molding, extruding, casting, cutting, grinding, stamping, bending, drilling, bonding, welding, mechanically connecting, a layering process, etching, soldering, and/or any other suitable process. Additionally, while the extendable light source can be attached to a firearm before the firearm is sold, in some embodiments, the extendable light source is configured to be retrofitted to the firearm.

Providing a Multi-Shot Mechanism

Although some embodiments of the described firearm 10 are configured to hold and fire a single bullet, cartridge, and/or other round (or projectile) before the endcap 20 is removed, a spent casing is ejected (or otherwise removed), and a new round is loaded into the firearm, in some other embodiments, the firearm is configured to hold and fire multiple bullets, cartridges, and/or other rounds before the firearm needs to be reloaded. In this regard, the firearm can comprise any suitable mechanism that allows it to hold and fire more than one bullet before needing to be reloaded (or before one or more additional rounds need to be placed in the firearm or a magazine and/or another mechanism that feeds rounds to the firearm).

Indeed, the firearm 10 can comprise any suitable loading mechanism. For instance, some embodiments of the firearm 10 comprise a revolver mechanism, a semi-automatic loading mechanism, a fully-automatic loading mechanism, a pump-action loading mechanism, a bolt-action loading mechanism, a breech-loading mechanism, a lever-action loading mechanism, a belt-fed loading mechanism, a gravity-feed reloading mechanism, a gas-operated loading mechanism, a blowback-operated loading mechanism, an auto-loading mechanism, a single-action mechanism, a double-action mechanism, a break-action loading mechanism, a falling-block mechanism, a rolling-block mechanism, a blow-forward mechanism, a recoil-operated loading mechanism, a double-action/single-action loading mechanism, a piston-driven mechanism, a direct-gas-impingement mechanism, a Gatling-gun loading mechanism, and/or any other suitable loading mechanism.

In some embodiments, however, the firearm 10 comprises a revolver mechanism. In such embodiments, the firearm can comprise any suitable type of revolver mechanism that allows a cylinder containing multiple rounds of ammunition to be rotated such that multiple shots can be fired from the firearm before the firearm is reloaded. Some examples of suitable revolver mechanism include, but are not limited to, a fixed cylinder mechanism, a loading gate mechanism, a top-break mechanism, a swing-out cylinder mechanism, a tip-up mechanism, a rear-entry mechanism, (e.g., via cap removal or otherwise), and/or any other suitable mechanism comprising a rotatable cylinder. In some embodiments, however, the firearm comprises a sliding-chamber, single-action, fixed-cylinder mechanism. In such embodiments, the firearm can be reloaded in any suitable manner (e.g., by removing the end cap 20 to access the cylinder, via a window, via a gate, and/or in any other suitable manner).

Where the firearm 10 is able to carry and fire more than one bullets and/or other rounds (or projectiles) before the firearm needs to be reloaded (or additional rounds need to be placed in the firearm, a cylinder of the firearm, a magazine of the firearm, and/or another mechanism), the firearm can comprise any suitable component or characteristic that allows it to function in such a manner. Some non-limiting examples of such components include one or more cylinders, moveable sleeves disposed in a cylinder, attachment bodies, followers, cylinder latches, locking notches, recoil shields, cylinder releases, cylinder stops, bolt stop pins, loading gates, loading windows, magazines (e.g., tubular magazines, integral box magazines, clip-fed revolution magazines, drum magazines, detachable box magazines, rotary magazines, pan magazines, helical magazines, strip loaders, etc.), magazine releases, magazine wells, bolts, gas tubes, gas pistons, extractors, extractor pins, ejectors, barrels (e.g., side-by-side barrels, over-and-under barrels, pepper-box barrels, Gatling gun barrels, etc.), springs, pins, plungers, slides, receivers, tappers, bolt stop pins, yokes, cylinder stop springs, cylinder stop studs, cylinder stops, rebound slides, rebound slide springs, rebound slide studs, rebound slide pins, bolt plungers, bolt plunger springs, stirrup studs, stirrups, stirrup pins, mainsprings, strain screws, stock pins, locking bolts, locking bolt pins, locking bolt springs, hand torsion spring pins, trigger studs, torsion springs, hands, hand pins, hand studs, disconnectors, retaining pins, plungers, recoil springs, recoil spring guide rods, recoil guide plunger springs, recoil spring guide plungers, magazine catches, magazine followers, drawbars, ejection ports, ratchet mechanisms, and/or other suitable components that allow the firearm to carry and fire multiple rounds.

In accordance with some embodiments, FIGS. 25-29 show that the firearm 10 comprises one or more attachment bodies 800, cylinders 820, movable sleeves 830, and/or barrels 25. With respect to the attachment body, some embodiments of the described firearm are manufactured to include an integral multi-shot mechanism that allows the firearm to carry and fire multiple shots before the firearm needs to be refilled with bullets. Thus, some such embodiments are able to fire multiple shots without the use of an attachment body. In some other embodiments, however, the attachment body 800 is configured to easily be added (and/or retrofit) to the firearm to convert the firearm from including a single-shot firing mechanism (as illustrated in FIGS. 2, 5, and 14) to a multi-shot firing mechanism.

While attachment body 800 can couple to the firearm 10 in any suitable manner (including, without limitation, by attaching to and/or between the frame 15 and the end cap 20, by attaching to the proximal end 65 of the frame, by being inserted within a portion of the frame, by attaching to a side of the frame, and/or in any other suitable manner), in some embodiments, the attachment body is configured to be coupled between the end cap and the frame.

Figure 27:
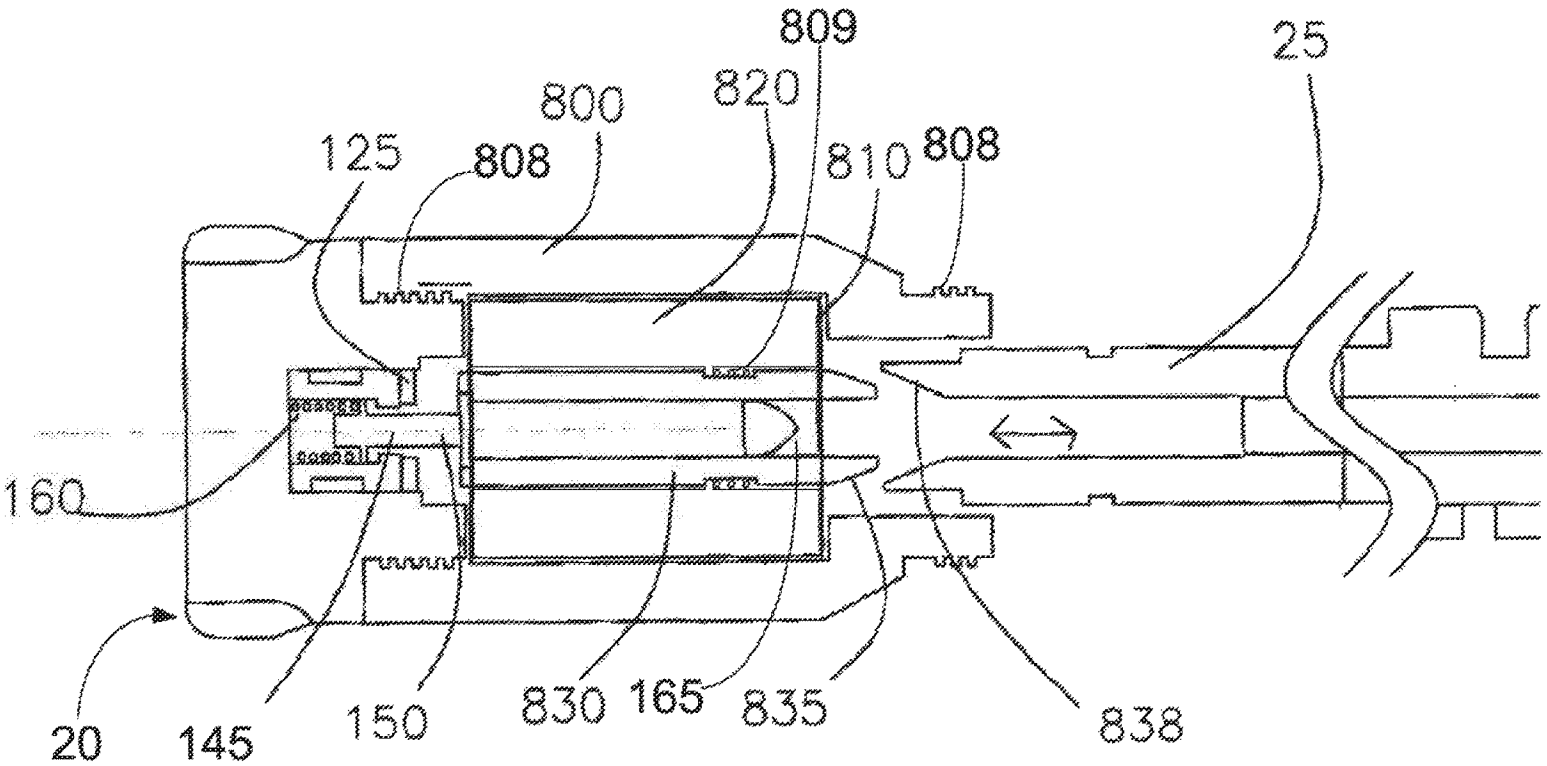
FIG. 27 illustrates a side, cross-sectional view of a portion of the firearm comprising the cylinder, in accordance with a representative embodiment.
Figure 28:
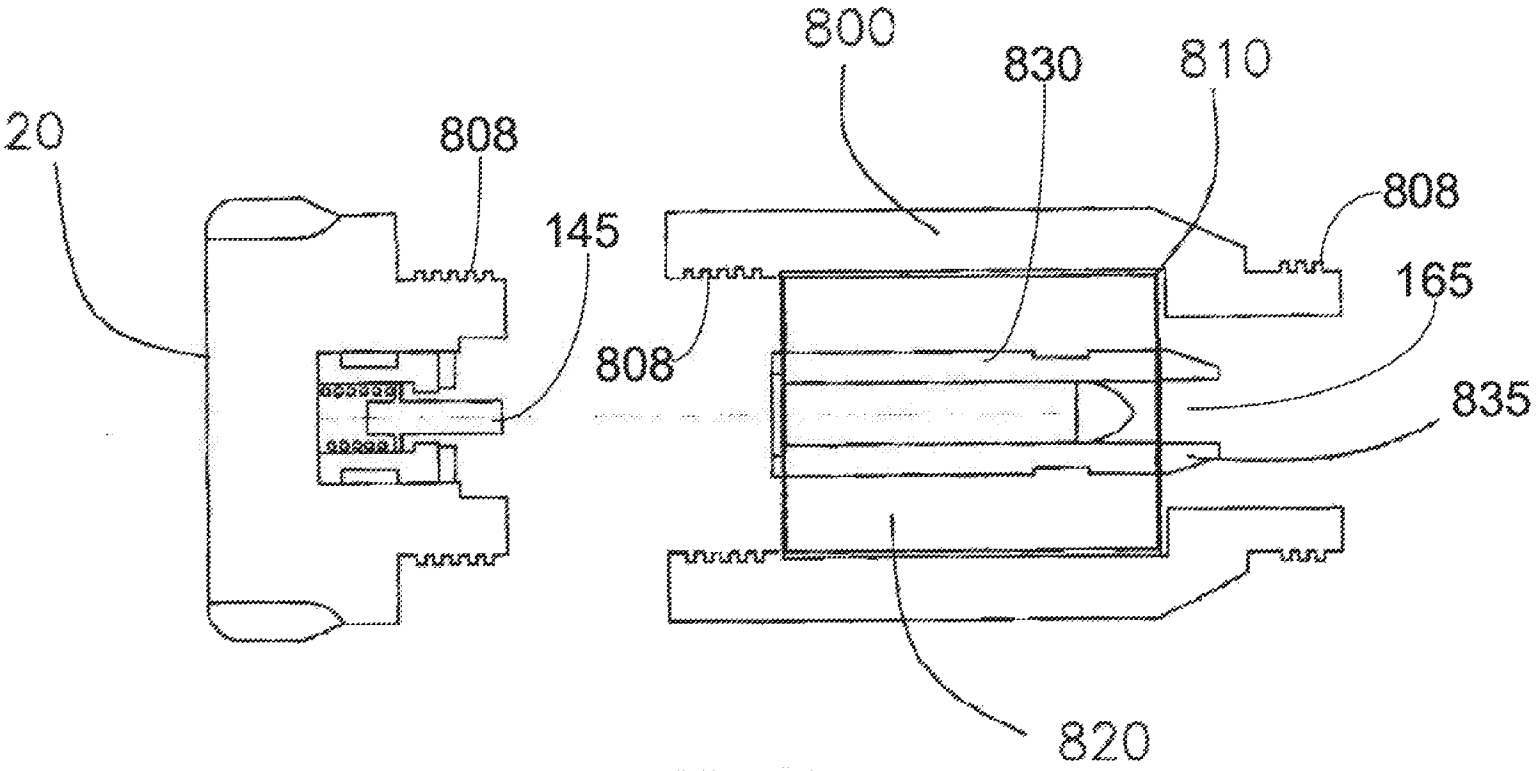
FIG. 28 illustrates a side, cross-sectional, exploded view of an attachment body comprising the cylinder, in accordance with a representative embodiment.
Figure 29:
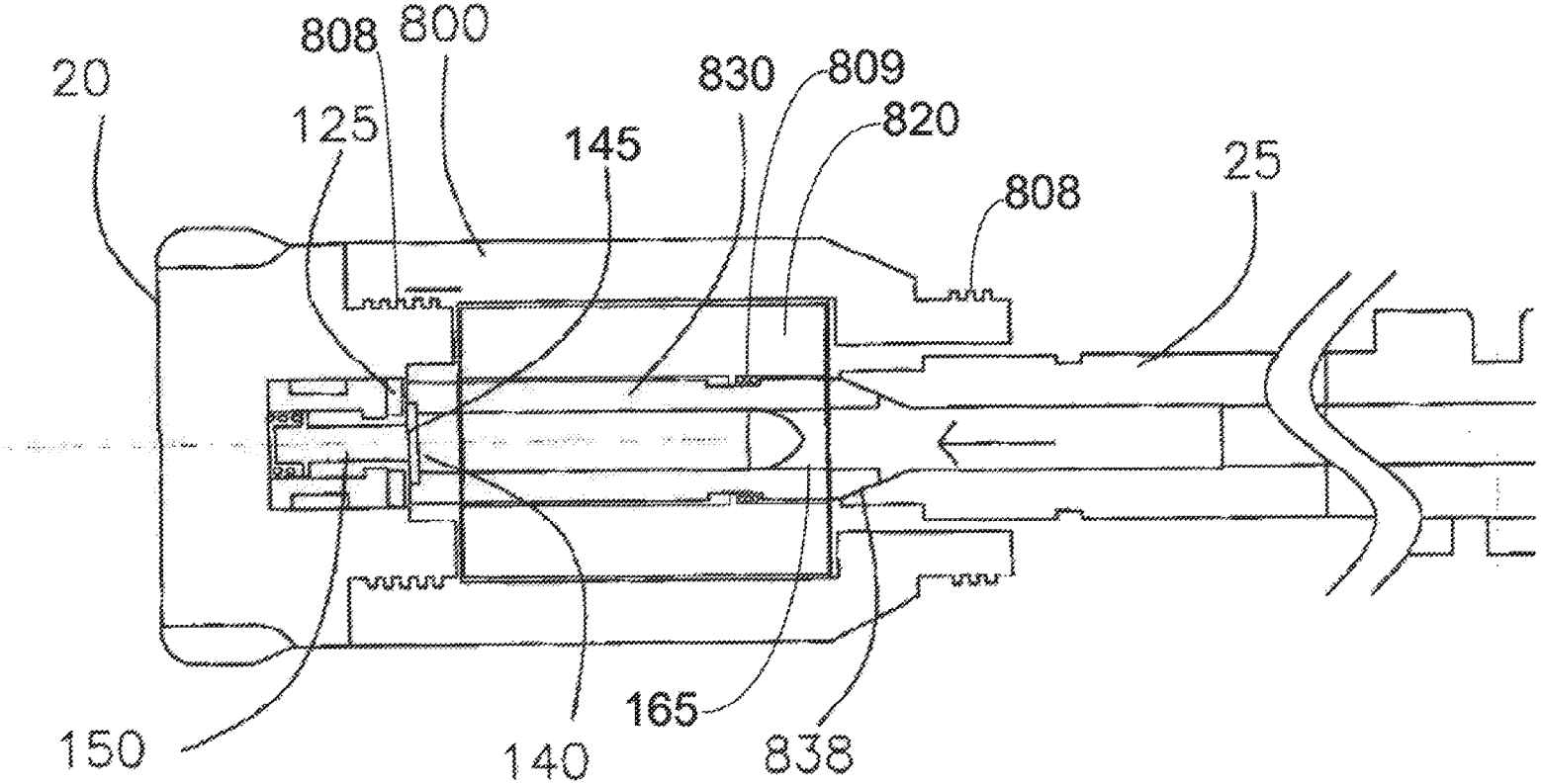
FIG. 29 illustrates a side, cross-sectional view of the attachment body, the cylinder, and the barrel, in accordance with a representative embodiment.

The attachment body 800 can couple to the frame 15 and/or end cap 20 in any suitable manner (e.g., via one or more screws, rivets, fasteners, frictional engagements, mechanical engagements, locking mechanisms, bayonet locks, threaded engagements, etc.). In accordance with some embodiments, however, FIGS. 27-29 show the attachment body 800 optionally couples with the end cap 20 and the frame 15 (not shown in FIGS. 27-29) via one or more threaded engagements 808.

Figure 26:
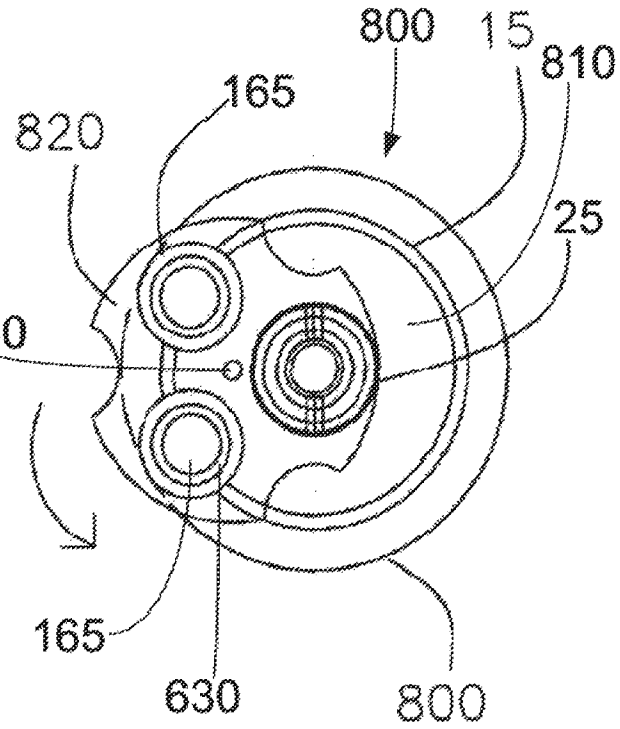
FIG. 26 illustrates a schematic view of the firearm with the cylinder, in accordance with a representative embodiment.

The attachment body 800 can function in any suitable manner, and serve any suitable purpose, that allows the firearm 10 to carry and fire multiple rounds. Indeed, in some embodiments, the attachment body couples a cylinder, magazine, clip, belt, and/or another object that is configured to carry and feed any suitable number of rounds of ammunition to the firearm. By way of non-limiting illustration, FIG. 26 shows a representative embodiment in which the attachment body 800 defines an interior cavity 810 that at least partially houses a cylinder 820. Although in some embodiments, this interior cavity is configured to completely house the cylinder, FIG. 26 shows an embodiment in which a portion of the cylinder 820 extends outside of the attachment body 800 (e.g., to allow a user to manually rotate the cylinder, to provide access to the cylinder for the insertion of bullets, and/or for any other suitable purpose).

In another example of a suitable function of the attachment body 800, in some embodiments, the attachment body helps to retain live and/or spent rounds in the firearm 10. While such a function can be performed in any suitable manner, FIG. 26 shows an embodiment in which a portion of the attachment body 800 is configured to overlap one or more ignition chambers 165 of the cylinder 820 to prevent rounds (not shown in FIG. 26) from sliding out of the firearm when the round's casings are not in contact with the follower 145 (described above). In this regard, FIGS. 27 and 29 show that, in some embodiments, the attachment body 800 is also configured to align at least one round and/or round casing (e.g., via the cylinder or otherwise) with the follower 145 and the barrel 25 such that the round can be fired from the barrel while the follower acts as a bolt face for the round (e.g., to prevent the round's casing from bulging, blowing out, misshaping, and/or otherwise deforming.

With respect to the cylinder 820, the cylinder can have any suitable component and characteristic that allows it hold 2, 3, 4, 5, 6, 7, 8, 9, or more rounds of ammunition, and such that the cylinder is able to move each of the rounds into a position in which the rounds can be fired from the cylinder. In one example of a suitable characteristic of the cylinder 820, the cylinder is configured to rotate with the respect to a portion of the firearm 10 in any suitable manner. Some non-limiting examples of components, systems, and characteristics that can be used to allow the cylinder to properly rotate include a pin about which the cylinder rotates, a pivoting mechanism, a bearing mechanism, a fixed cylinder design in which the cylinder is rotatably fixed in a single position with respect to firearm and/or attachment body 800 (e.g., with a loading gate, loading window, removable end-cap 20, and/or other provision for loading and/or unloading the firearm), a detent mechanism that is configured to releasably bias the cylinder in plurality of positions that are each configured to properly align a round in the firearm for discharge from the firearm, a ratchet mechanism that is configured to releasably maintain and/or move the cylinder in plurality of positions that are each configured to properly align a round in the firearm for discharge from the firearm, an indexing mechanism that is configured to properly rotate the cylinder, a double-action mechanism that is configured to rotate the cylinder as a result of actuation of one or more triggers (e.g., buttons 325) and/or movement of the cocking ring 45, a single-action mechanism that is configured to rotate the cylinder, a detachable cylinder mechanism, a swing-out cylinder mechanism, one or more finger contact surfaces (e.g., groves, ridges, recesses, protrusions, texturizing, etc.) that are to be contacted to manually rotate the cylinder to align a round with the barrel, a locking mechanism that selectively locks the cylinder in and releases the cylinder from one or more of a plurality of firing positions, one or more mechanisms that allow the cylinder to be rotated by one or more fingers and/or hands, and/or any other suitable mechanism that allows the cylinder to be selectively moved to, and be released from, multiple firing positions.

Figure 25:
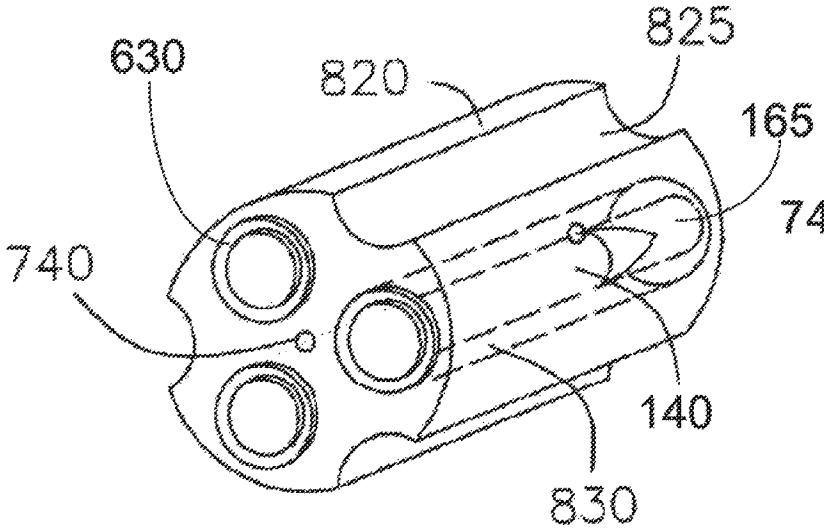
FIG. 25 illustrates a perspective view a representative embodiment of a cylinder for use in some embodiments of the firearm.

In one non-limiting illustration, FIG. 26 shows that, in some embodiments, the cylinder 820 is rotatably fixed to the attachment body 800 via a pin 740. Additionally, FIG. 25 shows that the cylinder 820 defines a plurality of finger grooves 825 that allow a user to manually rotate the cylinder between each of a plurality of firing positions (or positions that properly align a round (e.g., bullet 140) with the barrel 25 and follower 145). While the cylinder 820 can (as mentioned above) be selectively maintained in a firing position in any suitable manner, including, without limitation, via a detent, ratchet, indexing, and/or locking mechanism, in accordance with some embodiments, FIGS. 27 and 29 show that the cylinder 820 comprises one or more detent recesses 815. While such a mechanism may function in any suitable manner, in some embodiments, a detent pin, ball, and/or other suitable pawl is configured to extend into the detent recess and to then be slid out of the recess when the chamber is turned in one direction (e.g., clockwise) but not when the cylinder is pushed in an opposite direction (e.g., counterclockwise). Accordingly, in some such embodiments, the detent mechanism allows the cylinder to only rotate in a single direction.

As discussed earlier, some embodiments of the firearm 10 are configured such that in order to discharge the firearm, a round (or projectile) is carried proximally in the firearm to strike the firing pin 125. Indeed, as discussed above, in some embodiments, the round is carried proximally to the firing pin by an ignition chamber 165 portion of the barrel 25. In particular, in some embodiments in which the firearm is configured to hold and shoot multiple rounds before being reloaded, the barrel comprises an ignition chamber that is configured to carry a round (e.g., from a magazine, a belt, a cylinder, and/or any other suitable object capable of holding multiple rounds) proximally to the firing pin. In some other embodiments, the cylinder 820 (which defines 1, 2, 3, 4, 5, 6, 7, 8, 9, or more holes that are each configured to hold a round), or a portion of the cylinder, is configured to move proximally as the firearm is fired (e.g., when the cylinder is struck by the distal movement of the barrel). In still other embodiments, however, the cylinder defines a plurality of holes and each hole comprises a movable sleeve (e.g., sleeve 830 or otherwise) that is configured to hold a round and to be movable with respect to the cylinder so as to be able carry such a round proximally to the firing pin when the barrel is released from its distal cocked position such that the barrel strikes the sleeve.

While the movable sleeve 830 can comprise any suitable characteristic that allows it to house and carry a round proximally to the firing pin 125, in some embodiments, the sleeve is configured to translate proximally and/or distally with respect to the cylinder 820. Additionally, although some embodiments of the sleeve are not biased in either a proximal or medial direction with respect to the cylinder (but are instead able to translate freely within the cylinder), in some other embodiments, the sleeve is biased, at least slightly, in the distal direction. While this biasing can be performed in any suitable manner (e.g., via one or more springs, gaskets, elastomeric materials, biasing mechanisms, and/or other suitable mechanisms), in some embodiments, the movable sleeve is biased distally in the cylinder via one or more springs (e.g., spring 809 in FIGS. 27 and 29) that have less biasing force than does the proximal biasing mechanism 200 (discussed above). In some such embodiments, when the barrel 25 is released from the distal cocked position, a sleeve contact portion of the barrel 838 strikes a barrel contact portion 835 of the sleeve and causes the sleeve (and any round in the sleeve) to be moved proximally towards the firing pin.

Where the barrel 25 comprises a sleeve contact portion 838 and where the sleeve 830 comprises a barrel contact portion 835, such contact portions can comprise any suitable characteristic that allows the firearm 10 to function as intended. Indeed, in some embodiments, the two contact portions each comprise a flat, angled, rounded, and/or other corresponding shape that is configured mate and/or otherwise abut with each other when the firearm is fired. By way of non-limiting illustration, FIGS. 27-29 illustrate some embodiments in which the sleeve contact portion 838 and the barrel contact portion 835 each comprise tapered surfaces that are configured to mate when the firearm is discharged. In some such embodiments, this mating can help: ensure the projectile is properly directed from the sleeve and through the barrel, to increase muzzle velocity of the projectile by reducing the amount of pressure that escapes between the barrel and the sleeve, to reduce the amount of soot and fouling that could otherwise be introduced into the firearm by any gaps between the barrel and the sleeve, and/or to fulfill a number of other suitable functions.

In some embodiments, the sleeve contact portion 838 and the barrel contact portion 835 are configured to allow the firearm 10 to be discharged when the barrel 25 is any rotation (e.g., a safe and/or fire alignment position). In some other embodiments, however, the firearm is configured to only fire when the barrel is in a fire alignment position (e.g., as discussed above).

Where the firearm 10 only fires when the barrel 25 is in the fire alignment, the firearm and its various components can be modified and/or be configured in any suitable manner that allows the firearm to only fire when the barrel is in a fire alignment. In one example, the sleeve 830 is configured to be in a specific rotation (e.g., as directed by a ridge and groove, a pin and groove, and/or any other suitable components capable of maintaining the sleeve in a desired rotation with respect to the cylinder 820) when the sleeve is in its distal-most position with respect to the cylinder. In this example, the sleeve and/or barrel are configured in such a manner that the barrel is only able to force the sleeve to strike a primer end of a round against the firing pin 125 when the barrel is in the fire alignment.

Figure 30B:
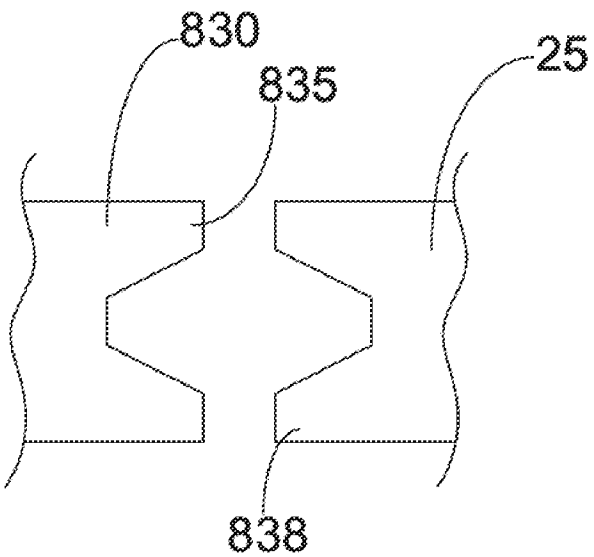
FIG. 30B illustrates a side view of the movable sleeve and barrel in a fire alignment position, in accordance with some embodiments.
Figure 30A:
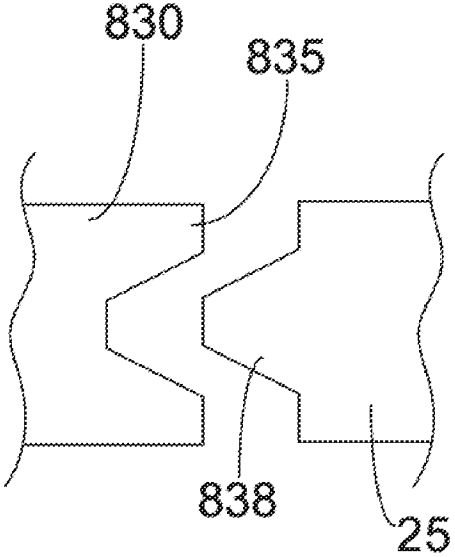
FIG. 30A illustrates a side view of a movable sleeve and barrel in a safe alignment position, in accordance with some embodiments.

While the sleeve 830 and/or barrel 25 can be configured in any suitable manner which allows firearm 10 to fire when the barrel is in the fire alignment, FIG. 30A shows an embodiment in which the sleeve contact portion 838 of the barrel 25 and the barrel contact portion 835 of the sleeve are configured to be able so slide past each other when the barrel is in the safe alignment to prevent the barrel 25 from forcing the sleeve to strike a round (not shown in FIG. 30A) in the sleeve 830 against the firing pin (not shown in FIG. 30A). In contrast, FIG. 30B illustrates an embodiment in which the barrel 25 is in the fire alignment such that the sleeve contact portion 838 and the barrel contact portion 835 are configured to contact each other when the barrel 25 is released from its distal cocked position, such that the barrel is configured to force the sleeve to strike a round (not shown in FIG. 30B) in the sleeve 830 against the firing pin 125 (not shown in FIGS. 30A-30B).

In addition to the aforementioned components, the multi-shot firearm 10 can comprise any other suitable component or characteristic. In one example in which the barrel 25 and sleeve 830 are configured to strike a round against the firing pin 125 only when the barrel is in the fire rotation, some such embodiments of the proximal end of the barrel and/or the distal end of the sleeve optionally comprise a shroud that is configured to extend around the junction between the sleeve and the barrel when the firearm is fired. In this example, the shroud can prevent flames from the explosion as the round is fired from contacting a user's hand and/or can fulfill a variety of other functions (e.g., increasing muzzle velocity of the round, reducing fouling inside the attachment body 800, etc.).

In addition to the aforementioned benefits, some embodiments of the described multi-shot firearm 10 allow a user to quickly fire multiple rounds from the firearm before being required to reload the firearm.

Thus, as discussed herein, some embodiments of the present invention relate to systems and methods for making and using a firearm that can be customized to perform one or more functions, such as firing a bullet, firing a less-than-lethal projectile, and/or providing light. In some implementations, the firearm is configured to carry and fire multiple bullets, cartridges, rounds, and/or other projectiles before the firearm needs to be reloaded.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A firearm comprising:

a firing pin;

a first ignition chamber that is configured to house a round of ammunition and to move proximally with respect to the firing pin so that when the round is in the first chamber the firearm is fired, a proximal end of the round is struck against the firing pin; and a follower that is configured to be movable proximally and distally within the firearm and to be biased against the proximal end of the round such that the follower is configured to selectively hold the round within the first chamber as the first chamber moves proximally, and wherein the follower is configured such that a proximal movement of the follower stops when the proximal end of the round strikes the firing pin such that the follower acts as a bolt face for the round; and wherein the first chamber is disposed within a cylinder, wherein the cylinder further comprises a second ignition chamber, and wherein the cylinder is configured to rotate to selectively align at least one of the first chamber and the second chamber with a barrel of the firearm.

2. The firearm of claim 1, wherein the first chamber comprises a first sleeve that is configured to receive the round, and wherein the first sleeve is slidably disposed within a cylindrical opening defined in the firearm.

3. The firearm of claim 2, wherein the first sleeve comprises a proximal end and a distal end, and wherein the distal end of the first sleeve comprises a barrel contact surface that is configured to be engaged by the barrel to cause the first sleeve to move proximally.

4. The firearm of claim 3, wherein the barrel comprises a proximal end and a distal end, and wherein the proximal end of the barrel comprises a sleeve contact surface.

5. The firearm of claim 1, wherein the firearm comprises a frame, an end cap, and an attachment body, wherein the end cap is configured to couple directly with the frame, wherein the attachment body is configured to couple with and between both the end cap and the frame, and wherein the first chamber is disposed in the attachment body.

6. The firearm of claim 1, further comprising a barrel and a first sear, wherein the barrel is configured to translate distally and proximally within the firearm, and wherein the first sear is configured to selectively engage the barrel to retain the barrel in a cocked position and to selectively disengage the barrel to fire the firearm.

7. The firearm of claim 6, wherein the barrel extends through a portion of the first sear, and wherein the first sear runs substantially perpendicular to a longitudinal axis of the barrel.

8. The firearm of claim 1, wherein the firearm further comprises:

a barrel comprising cocking block; and a cocking ring that engages a portion of the cocking block to move the barrel between a safe and a fire position.

9. The firearm of claim 7, further comprising a second sear, wherein the barrel extends through a portion of the second sear, and wherein the second sear runs substantially perpendicular to the longitudinal axis of the barrel.

10. The firearm of claim 6, wherein the barrel and the first sear are keyed to each other such that the barrel is sized and shaped to be captured by the sear when the barrel is rotated to a safe position and to be released and to translate with respect to the first sear when the barrel is rotated to a fire position.

11. The firearm of claim 8, further comprising a lever that is configured to be actuated to force the cocking ring and the barrel into a cocked position.

12. A firearm comprising:

a firing pin;

a barrel that is configured to translate proximally and distally in the firearm;

a first ignition chamber comprising a first sleeve, the first sleeve being configured to translate within the firearm such that when a round of ammunition is held in the first sleeve and when the barrel moves proximally and strikes the first sleeve, the first sleeve moves the round into contact with the firing pin to fire the round; and a follower that is configured to be biased against a proximal end of the round so as to selectively hold the round within the first sleeve as the first sleeve moves proximally, and wherein the follower is configured such that it's proximal movement stops when the round strikes the firing pin so that the follower acts as a bolt face for the round.

13. The firearm of claim 12, wherein a distal end of the first sleeve comprises a barrel contact surface, and wherein a proximal portion of the barrel comprises a sleeve contact surface that is configured to strike the first sleeve at the barrel contact surface to move the first sleeve proximally towards the firing pin.

14. The firearm of claim 12, wherein the firearm comprises a frame, an end cap, and an attachment body, wherein the end cap is configured to couple with the frame, wherein the attachment body is configured to couple with and between both the end cap and the frame, and wherein the first chamber is coupled to the attachment body.

15. A firearm comprising:

a firing pin;

a barrel that is configured to translate proximally and distally in the firearm;

a cylinder that rotatably attaches to the firearm, wherein the cylinder comprises multiple sleeves that slidably attach to the cylinder, wherein each of the sleeves defines an ignition chamber that is configured to hold a round of ammunition and to move the round within the firearm such that the round strikes the firing pin; and a follower that is configured to be biased against a proximal end of the round so as to selectively hold the round within a first sleeve of the multiple sleeves as the first sleeve moves proximally, and wherein the follower is configured such that it's proximal movement stops when the round strikes the firing pin such that the follower is configured to acts as a bolt face for the round.

16. The firearm of claim 15, wherein the firearm comprises a frame, an end cap that houses the follower, and an attachment body, wherein the end cap is configured to couple with the frame, wherein the attachment body is configured to couple with and between both the end cap and the frame, and wherein the cylinder is coupled to the attachment body.

17. The firearm of claim 15, further comprising a first sear, wherein the first sear is configured to selectively engage the barrel to retain the barrel in a cocked position and to selectively disengage the barrel to fire the firearm.

18. The firearm of claim 17, further comprising a second sear, wherein the barrel extends through a portion of the second sear, and wherein the second sear runs substantially perpendicular to the longitudinal axis of the barrel.

19. The firearm of claim 15, wherein a distal end each of the sleeves comprises a barrel contact surface, and wherein a proximal end of the barrel comprises a sleeve contact surface that is configured to strike barrel contact surface.

* * * * *